US012708134B2

(12) United States Patent
Link et al.

(10) Patent No.: US 12,708,134 B2
(45) **Date of Patent: *Aug. 18, 2026**

(54) METHOD OF PROCESSING TOBACCO FINES INTO A NON-CONTINUOUS TOBACCO MATERIAL

(71) Applicant: BRITISH AMERICAN TOBACCO EXPORTS LIMITED, London (GB)

(72) Inventors: Matthias Link, London (GB); Dietmar Franke, London (GB); Frank Plückhahn, London (GB)

(73) Assignee: NICOVENTURES TRADING LIMITED, London (GB)

( * ) Notice: Subject to any disclaimer, the term of this patent is extended or adjusted under 35 U.S.C. 154(b) by 476 days.

This patent is subject to a terminal disclaimer.

(21) Appl. No.: 18/245,224

(22) PCT Filed: Sep. 14, 2021

(86) PCT No.: PCT/GB2021/052379

§ 371 (c)(1),
(2) Date: Mar. 14, 2023

(87) PCT Pub. No.: WO2022/053835

PCT Pub. Date: Mar. 17, 2022

(65) Prior Publication Data

US 2023/0354876 A1 Nov. 9, 2023

(30) Foreign Application Priority Data

Sep. 14, 2020 (GB) ..... 2014431
Sep. 14, 2020 (GB) ..... 2014434
(Continued)

(51) Int. Cl.
*A24B 3/14* (2006.01)
*A24B 3/04* (2006.01)
(Continued)

(52) U.S. Cl.
CPC ..... *A24B 3/14* (2013.01); *A24B 3/04* (2013.01); *A24B 3/10* (2013.01); *A24B 3/182* (2013.01);
(Continued)

(58) Field of Classification Search
CPC .... A24B 3/04; A24B 3/14; A24B 3/18; A24B 5/16; A24B 9/00; A24B 15/12; A24B 15/14
See application file for complete search history.

(56) References Cited

U.S. PATENT DOCUMENTS 595,474 A 12/1897 Hayden et al.
4,681,126 A 7/1987 Strubel et al.
(Continued)

FOREIGN PATENT DOCUMENTS

CN 109123773 A * 1/2019 ..... A24D 3/0237
CN 109123773 B 1/2020
(Continued)

OTHER PUBLICATIONS

International Search Report and Written Opinion received for PCT Patent Application No. PCT/GB2021/052379, mailed on Nov. 29, 2021, 14 pages.
(Continued)

*Primary Examiner* — Eric Yaary
(74) *Attorney, Agent, or Firm* — WOMBLE BOND DICKINSON (US) LLP

(57) ABSTRACT

A method of processing tobacco fines into a non-continuous tobacco material, the method including providing a pre-sized tobacco stem material that has a Dp90 particle size of less than 3 mm and a Dp50 particle size of less than 2 mm. The method also includes combining the pre-sized tobacco stem material with tobacco fines to provide a tobacco initial material, and processing the initial material by setting the
(Continued)

initial material to a predefined increased moisture content, subjecting the initial material to an increase in temperature and subjecting the initial material an increased pressure in order to bind the tobacco fines to the tobacco stem material. There is also provided a non-continuous tobacco material produced by the method, a component for a delivery system including non-continuous tobacco material produced by the method, a product and a smoking article including the component.

22 Claims, 5 Drawing Sheets

(30) Foreign Application Priority Data

Aug. 20, 2021 (GB) ..... 2112001
Aug. 20, 2021 (GB) ..... 2112003

(51) Int. Cl.

| | |
|---|---|
| ***A24B 3/10*** | (2006.01) |
| ***A24B 3/18*** | (2006.01) |
| ***A24B 5/16*** | (2006.01) |
| ***A24B 7/04*** | (2006.01) |
| ***A24B 9/00*** | (2006.01) |
| ***A24B 13/02*** | (2006.01) |
| ***A24B 15/12*** | (2006.01) |
| ***A24C 5/01*** | (2020.01) |
| ***A24D 1/20*** | (2020.01) |

(52) U.S. Cl.
CPC ..... *A24B 5/16* (2013.01); *A24B 7/04* (2013.01); *A24B 9/00* (2013.01); *A24B 13/02* (2013.01); *A24B 15/12* (2013.01); *A24C 5/01* (2020.01); *A24D 1/20* (2020.01)

(56) References Cited

U.S. PATENT DOCUMENTS

| | | | | |
|---|---|---|---|---|
| 4,936,920 | A | 6/1990 | Keritsis et al. | |
| 8,820,328 | B2 | 9/2014 | Ehling et al. | |
| 11,702,532 | B2 | 7/2023 | Banzashi et al. | |
| 12,127,581 | B2 | 10/2024 | Iodice et al. | |
| 2005/0178398 | A1* | 8/2005 | Breslin | A24B 15/18 131/299 |
| 2007/0215167 | A1* | 9/2007 | Llewellyn Crooks | A24B 15/165 131/335 |
| 2008/0142027 | A1 | 6/2008 | Ehling et al. | |
| 2008/0196731 | A1* | 8/2008 | Ehling | A24B 15/12 131/370 |
| 2010/0139675 | A1 | 6/2010 | Ehling et al. | |
| 2011/0088705 | A1 | 4/2011 | Ehling et al. | |
| 2020/0108018 | A1 | 4/2020 | Shadurin et al. | |

FOREIGN PATENT DOCUMENTS

| | | | |
|---|---|---|---|
| DE | 102008063613 | A1 | 7/2010 |
| EP | 1219186 | A2 | 7/2002 |
| EP | 2540172 | A1 | 1/2013 |
| EP | 4144229 | A1 | 3/2023 |
| JP | 2023541645 | A | 4/2023 |
| JP | 2023541647 | A | 10/2023 |
| WO | 2021221120 | A1 | 11/2021 |

OTHER PUBLICATIONS

Search Report received for GB Patent Application No. 2113109.9, dated May 31, 2022, 2 pages.
Anonymous , "Mesh (scale)—Wikipedia", Retrieved from the Internet: URL:https://en.wikipedia.org/wiki/Mesh_(scale), on Apr. 7, 2020, 3 pages.

* cited by examiner

METHOD OF PROCESSING TOBACCO FINES INTO A NON-CONTINUOUS TOBACCO MATERIAL

PRIORITY CLAIM

The present application is a National Phase entry of PCT Application No. PCT/GB2021/052379, filed Sep. 14, 2021, which claims priority from GB Application No. 2014421.7, filed Sep. 14, 2020, GB Application No. 2014424.1, filed Sep. 14, 2020, GB Application No. 2112001.9, filed Aug. 20, 2021 and GB Application No. 2112003.5, filed Aug. 20, 2021, each of which hereby fully incorporated herein by reference.

TECHNICAL FIELD

The present disclosure relates to a method of processing tobacco fines into a non-continuous tobacco material, to a component, a product and a smoking article comprising said non-continuous tobacco material.

BACKGROUND

It is known to re-process tobacco fines which occur at different points during tobacco processing (e.g. transportation, tobacco preparation, production of cigarettes) to enable them to be put to a meaningful use. For example, tobacco fines may be used as one of the initial materials for tobacco reconstitution, e.g. producing reconstituted tobacco. Such processes usually enable continuous bodies of tobacco material to be produced, such as films, sheets, threads, etc.

Patent specification DE 100 65 132 A1 discloses a method of producing agglomerates from tobacco dust.

SUMMARY

According to a first aspect of the present disclosure, there is provided a method of processing tobacco fines into a non-continuous tobacco material, the method comprising providing a pre-sized tobacco stem material that has a Dp90 particle size of less than 3 mm and a Dp50 particle size of less than 2 mm; combining the pre-sized tobacco stem material with tobacco fines to provide a tobacco initial material; and, processing the initial material by setting the initial material to a predefined increased moisture content, subjecting the initial material to an increase in temperature and subjecting the initial material an increased pressure in order to bind the tobacco fines to the tobacco stem material.

The pre-sized stem material can have a Dp90 particle size of less than 2.9 mm and, preferably, less than 2.8, 2.7, 2.6, 2.5, 2.4, 2.3, 2.2, 2.1 or 2 mm. The pre-sized stem material can have a Dp50 particle size of less than 1.9 mm and, optionally, less than 1.8, 1.7, 1.6, 1.5, 1.4, 1.3, 1.2, 1.1 or 1 mm. The pre-sized stem material can have a Dp10 particle size of at least 100 microns and, optionally, a Dp10 particle size of at least 150, 200, 250, 300 or 350, 400 or 500 microns.

Providing the pre-sized tobacco stem material can comprise providing a starter stem material and using a hammer mill to reduce the particle size of starter stem material.

The increase in temperature can be obtained by applying external heat and/or is the result of creating mechanical pressure.

The initial material can further comprise winnowings.

The tobacco fines can have a particle size smaller than 1 mm and, optionally, smaller than 0.5 mm.

The tobacco fines can be bound to the pre-sized tobacco stem material mechanically, without using any externally applied binding agents. In some embodiments, the tobacco fines are bound by binding agents which occur naturally in or are inherent in the tobacco fines and/or tobacco stem material.

The material to be processed can be processed by conveying it continuously.

The step of processing the initial material can comprise conveying the initial material through a conveyor which builds up a mechanical pressure. The conveyor can comprise an extruder. The conveyer can be operated at a throughput of greater than 100 kg/hr and, preferably, at least 110 kg/hr and, preferably, at least 115 or 120 kg/hr.

In some embodiments, the material to be processed is processed in batches.

The method can comprise pre-conditioning the stem material and/or winnowings to one or more of the following parameters: Temperature: 80-147[deg.] C; Moisture: in the range of 6-14% OV by mass; and, Pressure (gas overpressure): 0-8 bar.

The method can comprise pre-conditioning the stem material and/or winnowings to one or more of the following parameters: Temperature: 100-120[deg.] C; Moisture: in the range of 8-12% OV by mass; and, Pressure (gas overpressure): 0-3 bar, and preferably, 0-1 bar.

Processing the initial material can comprise setting the initial material to a moisture content in the range 10 to 50% OV (oven volatiles) by mass.

In some embodiments, processing the initial material comprises setting the initial material to a moisture content of at least 10% OV (oven volatiles). In some embodiments, processing the initial material comprises setting the initial material to a moisture content of 50% or less OV (oven volatiles). In some embodiments, setting the initial material to the moisture content is performed before feeding the processed tobacco material through a shearing gap.

Processing the initial material can comprise heating the initial material to a temperature in the range of 60 to 180° C., preferably in the range of 100 to 140° C., and preferably in the range of 110 to 130° C.

In some embodiments, processing the initial material comprises heating the initial material to a temperature of at least 60° C. and, preferably, at least 100° C. or at least 110° C. In some embodiments, processing the initial material comprises heating the initial material to a temperature of 180° C. or less and, preferably, 140° C. or less and, preferably, 130° C. or less. In some embodiments, heating the initial material to the temperature is performed before feeding the processed tobacco material through a shearing gap.

Processing the initial material can comprise pressurizing the initial material to a pressure in the range 10 to 200 bar, and preferably in the range of 40 to 150 bar, and preferably in the range of 60 to 120 bar.

In some embodiments, processing the initial material comprises pressurizing the initial material to a pressure of at least 10 bar and, preferably, at least 40 bar and, preferably, at least 60 bar. In some embodiments, processing the initial material comprises pressurizing the initial material to a pressure of 200 bar or less and, preferably, 150 bar or less and, preferably, 120 bar or less. In some embodiments, pressurizing the initial material to the pressure is performed before feeding the processed tobacco material through a shearing gap.

The non-continuous tobacco material can be a fibrous and/or granular material.

The tobacco initial material can comprise at least 30% tobacco fines and, preferably, at least 35% or at least 40% tobacco fines (by mass).

The tobacco initial material can comprise 50% or less tobacco fines and, preferably, 45% or less or 40% or less tobacco fines (by mass).

In embodiments in which the tobacco fines material comprises exotic tobacco and/or other botanical material, the tobacco initial material can comprise 70% or less tobacco fines and, preferably, 65% or less or 60% or less tobacco fines (by mass).

The tobacco initial material can comprise at least 5% tobacco winnowings and preferably, at least 7%, 8%, 9% or 10% winnowings (by mass).

The tobacco initial material can comprise 20% or less tobacco winnowings (by mass) and preferably, 18% or less, 15% or less, 12% or less, or 10% or less winnowings (by mass).

The tobacco initial material can comprise at least 30% pre-sized tobacco stem material (by mass) and, preferably, at least 40%, 45% or 50% pre-sized tobacco stem material (by mass).

The tobacco initial material can comprise 70% or less pre-sized tobacco stem material (by mass) and, preferably, 60% or less, 55% or less, or 50% or less pre-sized tobacco stem material (by mass).

The tobacco fines can comprise, consist of, or essentially consist of, tobacco factory dust.

The tobacco fines may comprise exotic tobacco and/or other botanical material. For example, the tobacco fines may comprise 30-50%, preferably about 40%, of exotic tobacco, and 20-40%, preferably 25-31% of other botanical material in addition to tobacco material. In some embodiments, the tobacco fines may comprise Kretek material, which may comprise exotic tobacco such as Rajangan and/or Krosok tobacco, and clove dust. For example, the tobacco fines may comprise, consist of, or essentially so consist of, tobacco factory dust produced in the manufacture of Kretek smoking articles.

The tobacco fines can have a Dp50 particle size of smaller than 1 mm and, preferably, smaller than 0.5 mm.

The method can comprise exposing the processed tobacco material to a drop in pressure resulting in flash evaporation.

The method can comprise feeding the processed tobacco material through a shearing gap such that the processed tobacco material is defibrated by expansion.

The shearing gap can have a width in the range of 10 to 2000 microns and, preferably, in the range of 50 to 300 microns.

The shearing gap can be arranged between shearing surfaces, wherein a rotatable shearing member comprises one of the shearing surfaces.

The shearing member can comprise a plurality of grooves and, optionally, comprises at least 80 grooves and, optionally, at least 90, 100, 120, 140, 160 or 180 grooves. The grooves can each have a maximum width of at most 2 mm and, optionally, at most 1.5 or 1 mm.

The grooves can each have a maximum width of at least 0.3 mm and, optionally, at least 0.5 mm, 0.7 mm or 1 mm.

The method can comprise rotating the shearing member at an angular velocity of at least 10 rpm and, preferably, at least 100 rpm, 300 rpm, 300 rpm or 350 rpm. In some embodiments, the method comprises rotating the shearing member at an angular velocity of 700 rpm or less.

The non-continuous tobacco material can have an average fiber diameter of less than 0.9 mm, preferably less than 0.8 mm. The non-continuous tobacco material can have a density index in the range of 350 to 600 kg/m$^3$.

According to a second aspect of the present disclosure, there is provided a non-continuous tobacco material produced by the method of the first aspect above.

According to a third aspect of the present disclosure, there is provided a component for a delivery system, wherein the component comprises non-continuous tobacco material produced by the method of the first aspect above.

The component can further comprise a second tobacco material and, preferably, the second tobacco material can be cut-rag tobacco.

The non-continuous tobacco material can be configured such that the inclusion of the non-continuous tobacco material results in, during use of the component, an increased tar delivery in comparison to if the component did not comprise the non-continuous tobacco material.

The non-continuous tobacco material can be configured such that the inclusion of the non-continuous tobacco material results in, during use of the component, an increased tar delivery of at least 1.5%, 2% or 2.5% (by mass) for every 5% (by mass) inclusion of the non-continuous tobacco material.

The inclusion of the non-continuous tobacco material can result in, during use of the component, an increased nicotine delivery in comparison to if the component did not comprise the non-continuous tobacco material.

The non-continuous tobacco material can be configured such that the inclusion of the non-continuous tobacco material results in, during use of the component, an increased nicotine delivery of at least 1.5%, 2% or 2.5% (by mass) for every 5% (by mass) inclusion of the non-continuous tobacco material.

The inclusion of the non-continuous tobacco material can result in, during use of the component, a reduced carbon monoxide delivery in comparison to if the component did not comprise the non-continuous tobacco material.

The inclusion of the non-continuous tobacco material can result in, during use of the component, a reduced carbon monoxide to tar ratio delivery in comparison to if the component did not comprise the non-continuous tobacco material.

The non-continuous tobacco material can be configured such that the inclusion of the non-continuous tobacco material results in, during use of the component, a reduced carbon monoxide to tar ratio delivery of at least 1.5%, 2% or 2.5% (by mass) for every 5% (by mass) inclusion of the non-continuous tobacco material.

The component can comprise a tobacco rod for a combustible aerosol provision system.

The inclusion of the non-continuous tobacco material can result in, during use of the component, a reduced pressure drop across the component in comparison to if the component did not comprise the non-continuous tobacco material.

The component can comprise tobacco material that comprises the non-continuous tobacco material and the second tobacco material, and wherein at least 4.5%, 5.5% or 6.5% (by mass) of the tobacco material is non-continuous tobacco material produced by the method of the first aspect above, and optionally, at least 7%, 8%, 9%, 10%, 11%, 12%, 13%, 14%, 15%, 16%, 17%, 18%, 19% or 20% (by mass) of the tobacco material is non-continuous tobacco material produced by the method of the first aspect above.

The component can be for an aerosol provision system. The component can be a tobacco rod for a cigarette, cigar or cigarillo.

The component can be for a non-combustible aerosol provision system and, optionally, comprises a tobacco material wherein at least 5% of the tobacco material (by mass) is non-continuous tobacco material produced by the method of the first aspect above.

The component can be a tobacco rod.

According to a fourth aspect of the present disclosure, there is provided a product comprising a component according to the third aspect above.

According to a fifth aspect of the present disclosure, there is provided a smoking article comprising a component according to the third aspect above.

BRIEF DESCRIPTION OF THE DRAWINGS

Embodiments will now be described, by way of non-limiting example only, with reference to the drawings, in which.

DETAILED DESCRIPTION

Figure 1:
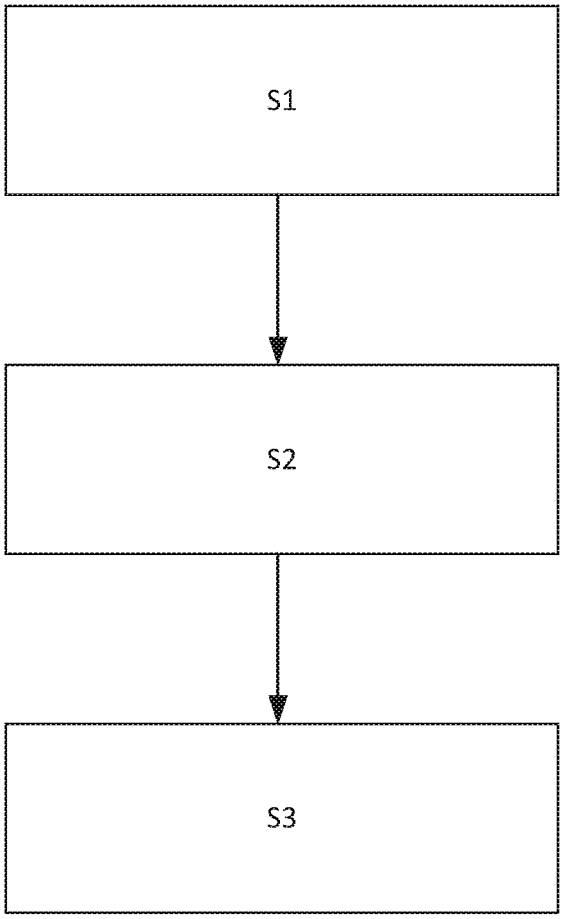
FIG. 1 is a flow chart illustrating an embodiment of a method of processing tobacco fines into a non-continuous tobacco material.

Referring to FIG. 1, a method for processing tobacco fines into a non-continuous tobacco material is shown.

The non-continuous tobacco material produced by the method may then be incorporated into a product. The product may be a component for a delivery system as described herein, for example, an aerosol provision system. In some embodiments, the aerosol provision system is a combustible aerosol provision system or a non-combustible aerosol provision system. The component may be, for example, a tobacco rod. In one particular embodiment, the component is a tobacco rod for a cigarette or a tobacco heating system. The product may be an article as used in a combustible aerosol provision system, such as a cigarette, cigarillo, cigar, or tobacco for pipes or for roll-your-own or for make-your-own cigarettes. The product may alternatively be an article for use in or with a non-combustible aerosol provision system that releases compounds from an aerosol-generating material without combusting the aerosol-generating material, such as an electronic cigarette, a tobacco heating product, and hybrid systems to generate aerosol using a combination of aerosol-generating materials. The product may alternatively be for use in or with an aerosol-free delivery system that delivers at least one substance to a user orally, nasally, transdermally or in another way without forming an aerosol, including but not limited to, lozenges, gums, patches, articles comprising inhalable powders, and oral products such as oral tobacco which includes snus or moist snuff, wherein the at least one substance may or may not comprise nicotine.

The method of processing tobacco fines into a non-continuous tobacco material comprises a step (S1) of providing a pre-sized tobacco stem material that has a Dp90 particle size of less than 3 mm and a Dp50 particle size of less than 2 mm; a step (S2) of combining the pre-sized tobacco stem material with tobacco fines to form a tobacco initial material; and, a step (S3) of processing the initial material by setting the initial material to a predefined increased moisture content, subjecting the initial material to an increase in temperature and subjecting the initial material an increased pressure in order to bind the tobacco fines to the tobacco stem material.

Pre-sized stem material refers to tobacco stem material that has been subjected to a pre-sizing step prior to combining the stem material with the tobacco fines to form the initial material.

In some embodiments, the step of providing a pre-sized tobacco stem material comprises providing a material that has a Dp90 particle size of less than 2.5 mm and a Dp50 particle size of between 0.7 mm and 1.5 mm.

In some embodiments, the pre-sized tobacco stem material has a particle size of less than 3 mm or less than 2 mm. In one embodiment, the pre-sizing step comprises passing the stem material through a 3 mm or 2 mm sieve and discarding, or processing to reduce the size of, any material that does not pass through the sieve.

It has been found that pre-sizing the stem material to a Dp90 value of less than 3 mm and a Dp50 value of less than 2 mm improves the quality, and particularly the consistency of the produced non-continuous material and the robustness of the material against mechanical stress. This means that a larger amount of the non-continuous material can be included in the component or product described herein, such as the component for the aerosol provision system, without sacrificing the quality of the component or product, including the organoleptic qualities of the component or product. Therefore, a larger amount of winnowings and tobacco fines can be recycled. It has also been found that such pre-sizing of the stem material means that the pressure defibration device can be operated at a higher throughput such that a greater amount of non-continuous material can be produced per hour. The manufacture of the non-continuous material will also be more repeatable and consistent. In some so embodiments, the pressure defibration device is run at a throughput of at least 100 kg/hr and, preferably, at least 110, 115 or 120 kg/hr.

In addition, pre-sizing the stem material means that larger stem material, for example, long or mixed stem, can be utilized and processed to have a Dp90 particle size of less than 3 mm and a Dp50 particle size of less than 2 mm, for instance a Dp90 particle size of less than 2.5 mm and a Dp50 particle size of between 0.7 mm and 1.5 mm. Thus, the process does not rely on the procurement of short stem.

Pre-sizing the stem material also results in fewer 'flakes' in the produced non-continuous material, as is described in more detail below.

Pre-sizing the stem material has also been found to reduce the separation of the stem and tobacco fines once they have been mixed together and, for example, whilst disposed in a mixing silo. Stem material and tobacco fines and, in particular, tobacco dust, have dissimilar particle sizes and shapes, which generally results in the stem material floating upwards whilst the dust is concentrated at the bottom. This de-mixing can cause inconsistency in the amount of stem and tobacco fines delivered to the defibration device, as the proportion of fines delivered to the defibration device decreases with time whilst the proportion of stem increases. Pre-sizing has been found to reduce such separation of the stem and tobacco factory dust in the mixing silo and thus results in a more consistently produced non-continuous material with a more consistent density.

In some embodiments, the pre-sized stem material has a Dp90 value of less than 2.9 mm and, for instance, a Dp90 value of less than 2.8, 2.7, 2.6, 2.5, 2.4, 2.3, 2.2, 2.1 or 2 mm. In some embodiments, the Dp90 value may be less than 1.9, 1.8, 1.7, 1.6 or 1.5 mm.

The Dp90 value refers to the particle size value that 90% of the stem material, by mass, is smaller than. For instance, if the Dp90 value is 3 mm then 90% (by mass) of the pre-sized stem material has a particle size smaller than 3 mm.

In some embodiments, the pre-sized stem material has a Dp50 value of less than 1.9 mm and, for instance, a Dp50 value of less than 1.9, 1.8, 1.7, 1.6, 1.5, 1.4, 1.3, 1.2, 1.1 or 1 mm. In some embodiments, the pre-sized stem material has a Dp50 value of less than 0.9 or 0.8 mm. The Dp50 value can alternatively or in addition be greater than 0.5 mm, 0.6 mm or 0.7 mm. In some embodiments, the Dp50 value is between 0.7 mm and 1.5 mm.

The Dp50 value refers to the particle size value that 50% of the stem material, by mass, is smaller than. For instance, if the Dp50 value is 2 mm then 50% (by mass) of the pre-sized stem material has a particle size smaller than 2 mm.

Smaller Dp50 and Dp90 values indicate smaller particle sizes and thus less separation of the pre-sized stem material from other constituents of the tobacco initial material and also fewer flakes in the produced non-continuous tobacco material.

In some embodiments, the step (S1) of pre-sizing the stem material results in a pre-sized stem material that has Dp10 value of at least 100 micrometers and, preferably, a Dp10 value of at least 150, 200, 250, 300 or 350 micrometers. In some embodiments, the Dp10 value may even be at least 400 or 500 micrometers.

The Dp10 value refers to the particle size value that 10% of the stem material, by mass, is smaller than. For instance, if the Dp10 value is 100 micrometers then 10% (by mass) of the pre-sized stem material has a particle size smaller than 100 micrometers. Higher Dp10 values indicate reduced amounts of fine dust, and thus lower densities of the produced non-continuous material, meaning that less is extracted as winnowings.

In some embodiments, the step (S1) of providing the pre-sized stem material comprises providing stem material and feeding the stem material to a particle size reduction device that is configured to reduce the size of the stem material. The particle size reduction device may be a milling/cutting/shredding device. In one embodiment, the size reduction device is a hammer mill. A hammer mill has advantageously been found to reduce the amount of dust that is generated. In another embodiment, the particle size reduction device is a centrifugal cutter. In another embodiment, the particle size reduction device is a shredder. The shredder may, for example, shred short stem and stem fibers.

In another embodiment, the stem material is pre-sized without any milling/cutting/shredding of the stem material and, instead, the stem material is sorted, with stems having a particle size outside a certain range being removed. This pre-sizing may involve sieving the stem material with a mesh that has, for example, a mesh size of 3 mm and rejecting stem material that does not pass through the sieve. If, for example, the Dp50 and/or Dp90 value is still larger or smaller than a target value (for example, 3 mm) then the material can be passed through further sieves to remove material that is too large/small as appropriate until the target Dp50 and/or Dp90 value is achieved, or material of a certain size can be added to achieve a target Dp50 and/or Dp90 value.

In some embodiments, the stem material is pre-sized to have a particle size of less than 2 mm (e.g. mesh size No. 10). In some embodiments, the stem material is pre-sized to have a particle size of less than 1.9 mm, 1.8 mm, 1.7 mm, 1.6 mm, or 1.5 mm. The pre-sizing may be optical (e.g. using a microscope), using sieves, or using a sorting or sieving machine. In one embodiment, the stem material is pre-sized to have a particle size of less than 1.68 mm (e.g. mesh size No. 12).

In some embodiments, the step (S2) of forming the tobacco initial material further comprises combining the pre-sized stem material and tobacco fines with winnowings. Thus, in such embodiments, the tobacco initial material comprises tobacco factory dust, tobacco winnowings, and pre-sized tobacco stem material.

'Tobacco fines' refers in particular to small pieces of tobacco which are conventionally regarded as problematic (including from a taste point of view) and are otherwise merely discharged by suction or can be used to produce reconstituted tobacco (tobacco film). In particular, tobacco fines are smaller than the cut width of tobacco (e.g. <1 mm) and more especially, tobacco fines are smaller than the cut width of tobacco (e.g. <0.5 mm). That is, tobacco fines have a particle size that is less than 0.5 mm.

In some embodiments, the tobacco fines comprises, consists of, or essentially consists of tobacco factory dust.

'Tobacco factory dust' refers to the fine dust that is generated as a by-product of tobacco processing and the manufacture of tobacco products such as cigarettes. Tobacco factory dust/tobacco dust has a particle size of less than 0.5 mm. In some embodiments, tobacco factory dust has a Dp50 of 125 micrometers. This means that 50% of the tobacco dust particles, by mass, have a particle size that is smaller than 125 micrometers.

'Tobacco fines' refers to material consisting of, or consisting essentially of, tobacco, and also encompasses tobacco material comprising exotic tobacco and/or a mixture of tobacco and other botanical material.

'Botanical material' refers to any material derived from a plant.

'Tobacco' and 'tobacco material' refers to any material derived from a plant from the genus *Nicotiana*.

'Other botanical material' or 'non-tobacco botanical material' refers to any material derived from any plant that is not a plant from the genus *Nicotiana*. Thus, non-tobacco botanical material includes, but is not limited to, *eucalyptus*, star anise, hemp, cocoa, *cannabis*, fennel, lemongrass, peppermint, spearmint, rooibos, chamomile, flax, ginger, *Ginkgo biloba*, hazel, hibiscus, laurel, licorice (liquorice), matcha, mate, orange skin, *papaya*, rose, sage, tea such as green tea or black tea, thyme, cinnamon, clove, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, *curcuma*, turmeric, sandalwood, cilantro, bergamot, orange blossom, myrtle, cassis, valerian, pimento, mace, damien, marjoram, olive, lemon balm, lemon basil, chive, *carvi, verbena*, tarragon, geranium, mulberry, *ginseng*, theanine, theacrine, maca, ashwagandha, damiana, guarana, chlorophyll, baobab, or any combination thereof. The mint may be chosen from the following mint varieties: *Mentha* Arventis, *Mentha* c.v., *Mentha niliaca, Mentha piperita, Mentha piperita citrata* c.v., *Mentha piperita* c.v, *Mentha spicata* crispa, *Mentha cardifolia, Mentha*

*longifolia, Mentha suaveolens variegata, Mentha pulegium, Mentha spicata* c.v. and *Mentha suaveolens.*

The non-tobacco botanical material may be clove. For example, the clove material may include, but is not limited to, the following type of clove material: Jawa, Bali, Manado, and/or Manado second grade.

Thus, in some embodiments, the tobacco fines comprise tobacco and non-tobacco botanical material. For example, the tobacco fines may comprise tobacco and clove material.

The clove material may consist of, or essentially consist of, clove processing dust, which may be produced as a by-product during the processing of clove buds.

The processing of clove buds may include the following steps:

1. Separation of clove plant material;
2. Sieving;
3. Conditioning, for example, using a conditioning screw and/or a temperature of about 70° C., and a moisture content of 30-45%, such 38%;
4. Bulking, for example, in a bulking silo for at least 3 hours;
5. Cutting; and
6. Drying, for example, using hot air, to a moisture content of less than 12%.

In preferred embodiments, the clove material that may be present in tobacco fines comprises clove processing dust produced during the cutting step of clove bud processing. Preferably, tobacco fines do not include material produced during the separation of the clove plant material, for example, due to the possible presence of foreign matter and/or due to an undesirable silica content.

The use of clove material in the tobacco fines may provide a distinctive flavor and sensorial experience for the end user. Cloves are known to have sensory effects including aroma, spicy, numbing, crackling, and throat soothing features among others. The organoleptic properties of the non-continuous tobacco material produced by the disclosed method may thus be altered and improved.

The inclusion of clove in tobacco material has a historic precedent in some regions, in which it may be referred to as a 'Kretek blend', or 'Kretek material'.

Thus, in some embodiments, the tobacco fines comprise Kretek material. For example, the tobacco fines may comprise, consist of, or essentially consist of tobacco factory dust produced during the manufacture of smoking articles comprising Kretek material.

Kretek material may comprise 20-80%, such as about 69-75%, tobacco (by mass).

Kretek material may comprise exotic tobacco material.

'Exotic tobacco' includes but is not limited to the following tobacco materials: Rajangan tobacco, which may be dark Rajangan tobacco or bright Rajangan tobacco, Krosok, Madura, Maesan, Weleri, Pakpie Ploso, Temanggung, KASTURI, Boyolali, and/or Ploso.

Kretek material may comprise 30-50%, such as about 40%, exotic tobacco (by mass).

Kretek material may comprise clove material in an amount of 20-40%, such as 25-31%, (by mass).

Thus, the tobacco fines may comprise Kretek blend material. As an example, a mild Kretek blend may have the following composition: Rajangan tobacco (38% by mass), tobacco stem material (14% by mass), Krosok tobacco (4% by mass), FCV/Oriental tobacco (19% by mass), and clove material (25% by mass).

As a further example, another Kretek blend may have the following composition: Rajangan tobacco (30% by mass), tobacco stem material (11% by mass), Krosok tobacco (5% by mass), FCV/Oriental tobacco (23% by mass), and clove material (31% by mass).

Generally, a Kretek blend may include (by mass) 30-38% Rajangan tobacco, 11-14% tobacco stem material, 4-5% Krosok tobacco, 19-23% FCV/Oriental tobacco, and 25-31% clove material.

In some embodiments, the tobacco fines comprise Kretek material and additional clove material as defined herein. For example, the tobacco fines may comprise tobacco material, Kretek material, and clove processing dust. The Kretek material and clove processing dust may be included in the tobacco fines in a ratio of between 40:5 and 50:1, such as, for example, in a ratio of 47:3 (Kretek material: clove processing dust, by mass).

In some embodiments, the tobacco fines comprise tobacco dust, Kretek material, and additional clove material as defined herein. For example, the tobacco fines may comprise tobacco factory dust produced during the manufacture of smoking articles comprising tobacco material, Kretek factory dust material produced during the manufacture of smoking articles comprising Kretek material, and clove processing dust produced as a by-product during the processing of clove buds.

Tobacco winnowings are coarsely cut stem particles, midrib or stalk, but can include some lamina and reconstituted sheet, which have been sorted and removed from already cut tobacco because they are conventionally considered to be undesirable in aerosol provision systems due to their size and shape and would impair the quality of the aerosol provision systems, for example, cigarettes. For this reason, conventionally winnowings are usually recycled or disposed of as a waste product.

Tobacco winnowings may refer to winnowings from cigarette production (CPP-winnowings=winnowings from cigarette production/packaging) or those from tobacco processing (TP-Winnowings). The term 'winnowings' hereinafter encompasses both winnowings from cigarette production and those for tobacco processing, unless otherwise stated.

At step (S3), the tobacco initial material is subjected to increased mechanical pressure and in particular also increased temperature and moisture, in order to keep the tobacco fines adhered to the tobacco stem material and winnowings.

The tobacco initial material is brought to a pre-defined increased moisture content. The material to be processed is also subjected to an increase in temperature, which may be obtained in particular by applying heat from outside and/or by mechanically generating pressure.

In some embodiments, the tobacco initial material is heated to a temperature of 60° C. to 180° C., preferably 100° C. to 140° C., and preferably 110° C. to 130° C.

In some embodiments, the tobacco initial material is brought to a pressure of 10 to 200 bar, in particular 40 to 150 bar, preferably 60 to 120 bar. Pressures referred to herein refer to above atmospheric pressure, unless otherwise stated.

In some embodiments, the dwell time of the tobacco initial material may be less than 3 minutes, in particular less than 2 minutes and preferably less than 1 minute.

As a result of step (S3), the tobacco fines are bound to the stem material and winnowings to produce a non-continuous tobacco material that may be used subsequently for the production of aerosol provision systems. This obviates the need for expensive separate processes. The tobacco fines are simply bound/adhered to the remaining material.

As a result of this process, there is a significant shift in size distribution towards larger particles.

The tobacco initial material is therefore subjected to a mechanical pressure at an increased temperature and defined moisture level (e.g. in an extruder or a conveyor screw-conditioner). Due to the mechanical pressure, the tobacco fines are pressed onto the pre-sized tobacco stem material and winnowings and intimately bound to it. As a result of this, the binding of the tobacco fines to the stem material and winnowings is so strong that the tobacco material treated as proposed by the invention is resistant to the normal stresses which occur during cigarette production, i.e. the tobacco fines no longer drop off when being conveyed by air under normal production conditions. Mechanical stability is therefore higher than is the case with conventional tobacco film materials.

A higher proportion of tobacco fines in the tobacco initial material is advantageous because it means that more of the tobacco fines, which are usually a waste by-product of manufacturing that would otherwise be disposed of, can instead be recycled. In some embodiments, the tobacco initial material comprises at least 30% tobacco fines (by mass) and, preferably, at least 35% tobacco fines (by mass).

In some embodiments, the tobacco initial material comprises 50% or less tobacco fines (by mass) and, preferably, 45% or less tobacco fines (by mass) or 40% or less tobacco fines (by mass). It has been found that using so % tobacco fines, and preferably 45% or less tobacco fines or 40% or less tobacco fines is advantageous because using a greater amount has been found to negatively impact the quality of the produced non-continuous tobacco product and result in a high density of the produced non-continuous tobacco product that causes more of the non-continuous tobacco produce to be extracted as winnowings.

In some embodiments, the tobacco initial material comprises in the range of about 30 to 50% tobacco fines (by mass). It has been found that a tobacco initial material that has in the range of 30 to 50% achieves a good compromise between, on the one hand, so using a beneficial amount of tobacco fines that would otherwise be disposed of and, on the other hand, not using too much tobacco fines that would otherwise negatively impact the quality and result in a high density of the produced non-continuous tobacco material. Preferably, the tobacco initial material comprises in the range of about 35% to 45% tobacco fines (by mass), and, preferably about 40% tobacco fines. The tobacco fines may comprise, consist of, or essentially consist of, tobacco dust.

In some embodiments, the tobacco initial material comprises in the range of about 30 to 50% tobacco dust (by mass) and, preferably, in the range of about 35% to 45% tobacco dust (by mass), and, preferably about 40% tobacco dust (by mass).

In embodiments in which the tobacco fines material comprises exotic tobacco and/or other botanical material, the tobacco initial material can comprise up to 70% tobacco fines and, preferably, up to 65% or 60% tobacco fines (by mass).

In some embodiments, the tobacco initial material at least 5% tobacco winnowings and preferably, at least 7, 8, 9 or 10% tobacco winnowings (by mass). In some embodiments, the tobacco initial material comprises 20% or less tobacco winnowings and preferably, 15% or less winnowings (by mass).

In some embodiments, the tobacco initial material comprises in the range of 5 to 20% (by mass) tobacco winnowings and preferably, in the range of 5 to 15% winnowings and, preferably, about 10% winnowings (by mass). In some embodiments, the winnowings are not pre-sized.

In some embodiments, the tobacco initial material comprises at least 30% pre-sized tobacco stem material and, preferably, at least 40%, 45% or 50% pre-sized tobacco stem material (by mass).

In some embodiments, the tobacco initial material comprises 70% or less pre-sized tobacco stem material and, preferably, 65% or less, 60% or less or 55% or less or 50% or less pre-sized tobacco stem material (by mass).

In some embodiments, the tobacco initial material comprises in the range of 30 to 70% pre-sized tobacco stem material and, preferably, in the range of 40 to 60% pre-sized tobacco stem material and, preferably, about 50% pre-sized tobacco stem material (by mass).

In some embodiments, the tobacco initial material comprises between 30 to 50% tobacco fines, between 5 to 20% tobacco winnowings, and between 30 to 70% tobacco stem material (by mass). However, it should be recognised that other amounts of tobacco fines, winnowings and tobacco stem material are possible. Preferably, the initial material comprises between 20 to 40% tobacco fines, 10 to 15% tobacco winnowings and 40 to 60% tobacco stem material (by mass). More preferably, the initial material comprises between 25 to 35% tobacco fines, 10 to 15% tobacco winnowings and 45 to 55% tobacco stem material (by mass).

In some embodiments, the tobacco fines may comprise, consist of, or essentially consist of, a tobacco dust material, for example, tobacco factory dust. The tobacco fines may comprise exotic tobacco and/or a mixture of tobacco and other botanical material.

In embodiments in which the tobacco fines material comprises exotic tobacco and/or other botanical material, the tobacco initial material may comprise between 30 to 70% tobacco fines, up to 20% tobacco winnowings, and between 30 to 70% tobacco stem material (by mass). However, it should be recognized that other amounts of tobacco fines, winnowings and tobacco stem material are possible. Preferably, the initial material comprises between 20 to 65% tobacco fines, 0 to 15% tobacco winnowings and 40 to 60% tobacco stem material (by mass). More preferably, the initial material comprises between 25 to 60% tobacco fines, 0 to 10% tobacco winnowings and 35 to 55% tobacco stem material (by mass).

As a result of step (S3), it is not necessary to add extra or external binding agents to bind the tobacco fines to the tobacco stems and winnowings: neither binding agents that are foreign to the tobacco nor inherent binding agents, i.e. which naturally occur in the tobacco. Instead, the tobacco fines can be bound with the tobacco stems and winnowings mechanically and/or by the quantities of binding agents which naturally occur in the tobacco (inherent binding agents). Such inherent binding agents (for example, starch, resins, and sugars) are activated and thus bind the tobacco fines firmly to the tobacco stems and winnowings. This is in contrast to methods that rely on the addition of binding agents, including methods of producing films or agglomerates that rely on the addition of binding agents.

The processing preferably results in a product which is a non-continuous tobacco material, in particular a fibrous and/or granular material or filler material. In other words, the method results in a product which is ready for consumption and can be used directly in an aerosol provision system, for example, to produce a tobacco rod for a cigarette or a tobacco heating device. This is very different from producing tobacco film (continuous tobacco material), which is more complex to produce and which still has to be cut and dried after production. The product obtained as a result of the present disclosure is of a size and moisture content which make it suitable for use directly as a filler material for aerosol provision systems, including cigarettes and tobacco heating devices.

In some embodiments, the initial material is processed in batches, in particular pressed in batches, for example, in a piston-cylinder unit.

It has been found that the non-continuous tobacco material produced by the method of FIG. 1 has an increased tar and nicotine delivery, a reduced carbon monoxide delivery, a reduced carbon monoxide to tar ratio, a reduced pressure drop across a component comprising the non-continuous tobacco material and a reduced firmness and fill value of a component comprising the non-continuous tobacco material.

Figure 2:
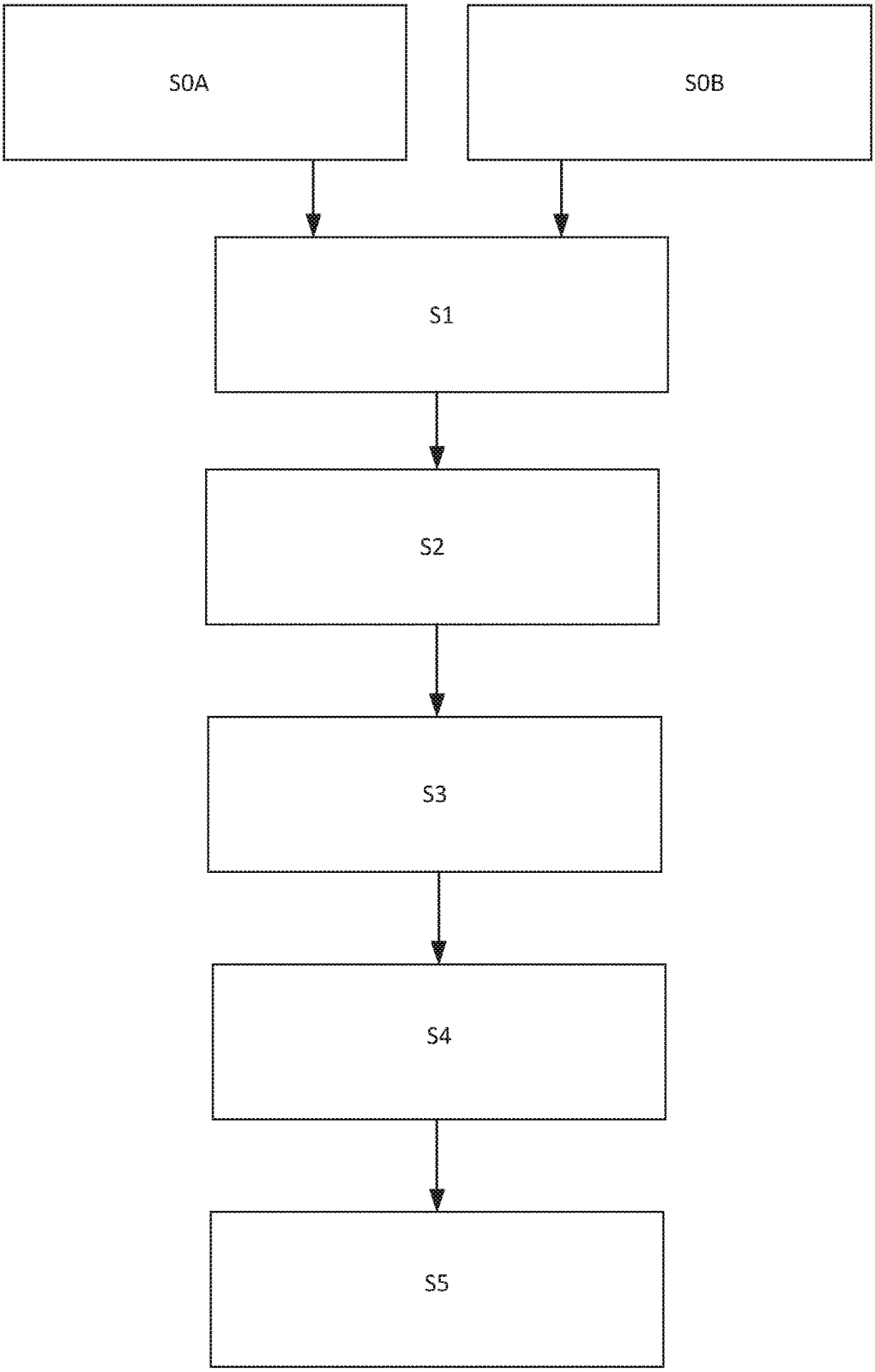
FIG. 2 is a flow chart illustrating another embodiment of a method of processing tobacco fines into a non-continuous tobacco material.

Referring now to FIG. 2, another embodiment of a method of processing tobacco fines into a non-continuous tobacco material is shown.

The method of the embodiment of FIG. 2 is similar to the method of FIG. 1 in that it comprises: a step (S1) of providing a pre-sized tobacco stem material that has a Dp90 particle size of less than 3 mm and a Dp50 particle size of less than 2 mm; a step (S2) of combining the pre-sized tobacco stem material with tobacco fines to form a tobacco initial material; and, a step (S3) of processing the initial material by setting the initial material to a predefined increased moisture content, subjecting the initial material to an increase in temperature and subjecting the initial material an increased pressure in order to bind the tobacco fines to the tobacco stem material. A detailed description of these steps (S1 to S3) will not be repeated hereinafter.

The method of FIG. 2 further comprises a step (SoA) of conditioning the stem material; a step (SoB) of conditioning the winnowings; a step (S4) of feeding the initial material through a shearing gap to form a non-continuous tobacco material; and, a step (S5) of cooling the non-continuous tobacco material.

It should be recognized that in some embodiments (not shown), one or more of steps (SoA), (SoB), (S1), (S2), (S3), (S4) or (S5) may be combined. For instance, the tobacco initial material may be conditioned whilst in the feeding apparatus, for example, being brought to initial conditions (such as, temperature, moisture and pressure) whilst travelling through a screw feeder of the feeding apparatus, or may be conditioned in the defibration device.

It should also be recognised that in some embodiments (not shown), one or more of steps (SoA), (SoB), (S1), (S2), (S3), (S4) or (S5) may be in a different order or omitted entirely. For example, the tobacco stem, winnowings and/or tobacco fines may be conditioned prior to being combined together. The stem material may be conditioned before or after being subjected to the pre-sizing step (S1). However, in the present example the stem material is conditioned before being subjected to the pre-sizing step (S1).

In steps (SoA) and (SoB), the stem material and the winnowings are respectively brought to one or more of the following initial conditions (values given for pressure are always above atmospheric pressure):

Temperature: 80-147[deg.] C., preferably 100-120[deg.] C.

Moisture: in the range of 6-14%, preferably in the range of 8-12%

Pressure (gas over-pressure): 0-8 bar, and preferably, 0-3 bar, and preferably, 0-1 bar.

That is, the stem material is brought to one, more than one, or all of the above conditions at step (SoA) and separately the winnowings are brought to one, more than one, or all of the above conditions at step (SoB). Step (SoA) can be before or after step (SoB) or at the same time as step (SoB). In some embodiments, steps (SoA) and (SoB) are combined.

This pre-conditioning may take place under atmospheric conditions. Alternatively, in some embodiments the pre-conditioning process is operated at a pressure above atmospheric pressure, as described in patent specification DE 103 04 629 A1. During pre-conditioning and/or simultaneously during the process (atmospheric or above atmospheric pressure), casing and flavoring agents may be added, in a manner known to those skilled in the art.

Preferably, at step (SoA) the stem material is brought to all of the above initial conditions. Preferably, at step (SoB) the winnowings are brought to all of the above initial conditions.

The step (S3) of processing the initial material by setting the initial material to a predefined increased moisture content, subjecting the initial material to an increase in temperature and subjecting the initial material to an increased pressure in order to bind the tobacco fines to the tobacco stem material is preferably operated on the basis of one or more of the following a parameters:

Temperature: 80-180[deg.] C., preferably 125-156[deg.] C.

Moisture: in the range of 15-50%, preferably in the range of 18-45%.

Mechanical pressure: 80-250 bar, preferably 72-132 bar.

Preferably, step (S3) is operated on the basis of all of the above parameters for temperature, moisture and mechanical pressure. In other words, the material is brought to the above temperature, moisture and pressure values.

At step (S3), the tobacco initial material is subjected to an increased pressure, as explained above. At the step (S4) of feeding the initial material through a shearing gap to form a non-continuous tobacco material, this increased pressure drops again. This usually takes place on discharge from a processing apparatus (e.g. extruder, screw conveyor, piston-cylinder unit) that subjects the tobacco initial material to the increased temperature, pressure and moisture. The drop in pressure on discharge from this shearing gap results in a flash evaporation, thereby causing the material to expand. This advantageously increases the filling capacity of the material.

At step (S3), the tobacco initial material is heated and placed under pressure to improve the flavor through chemically operated processes (e.g. Maillard reaction or caramelization) and also to store energy to promote the by shearing and expansion through the shearing gap. The pressure generation and heating may be operated with standard plug screw feeders, the housings of which in particular may also be heated.

Figure 3:
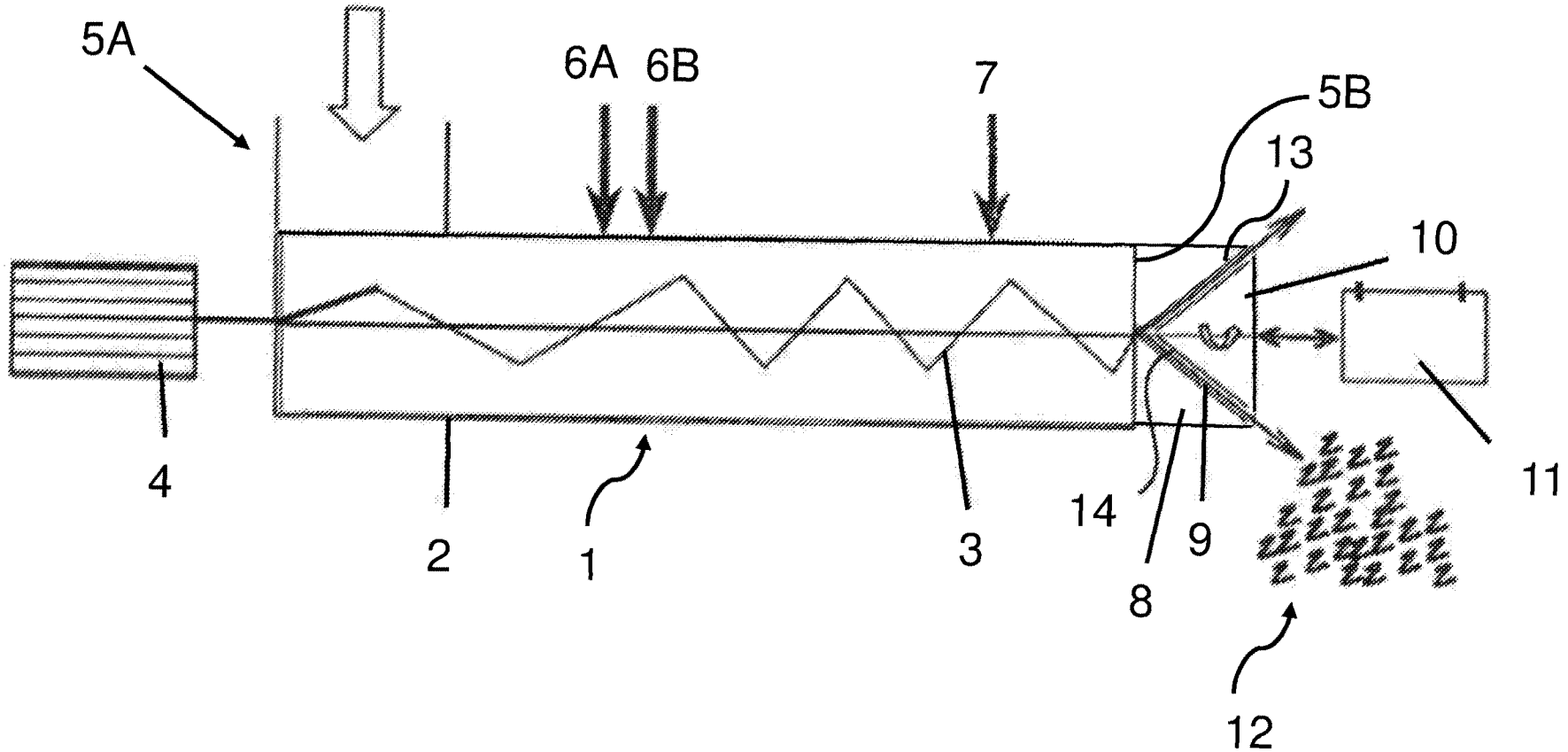
FIG. 3 is a schematic view of an embodiment of a pressure defibrating device.

In some embodiments, the step (S3) of processing the initial material and/or the step (S4) of feeding the initial material through the shearing gap to form a non-continuous tobacco material is performed using an apparatus of the configuration shown in FIG. 3.

At step (S4), the feeding of the initial material through the shearing gap to form a non-continuous tobacco material promotes defibration of the material. In some embodiments, on leaving the shearing gap and entering the atmosphere, the entrained water evaporates abruptly and optionally also other entrained ingredients, which, in addition to the shearing effect, causes the material to be defibrated and expanded in the shearing gap. The moisture of the material is reduced to in the range of 5 to 25% and, preferably, 10 to 20% due to the flash evaporation, depending on the process pressure and temperature, and ingredients contained in the tobacco are also reduced to a certain extent. It has been found to be advantageous if the shearing gap surfaces are moved relative to one another to prevent and clear blockages. This ensures that the full cross-sectional surface of the gap is used and constant physical conditions prevail at the gap, which ultimately results in a uniform product. To this end, it has also proved to be of advantage if the gap surfaces are structured or profiled, for example, having grooves, as will be described in more detail below.

At step (S5), the tobacco material is cooled, for example from above 100° C. to room temperature, which may take place on a conveyor belt on the basis of air suction and may be operated from underneath. During the cooling process the tobacco material loses more moisture due to cooling by evaporation thereby making it possible to arrive at the moisture level of the end product without a dryer. The cooled tobacco material may have a moisture content, for example, in the range of 10 to 20% and, preferably in the range of 13% to 16%.

In some embodiments, the tobacco material is fed through an expansion and drying process, after which the non-continuous tobacco material will have a reduced moisture content, for example, in the range of 10 to 20% and, preferably in the range of 13% to 16%.

It has been found that the non-continuous tobacco material produced by the method of FIG. 2 has an increased tar and nicotine delivery, a reduced carbon monoxide delivery, a reduced carbon monoxide to tar ratio, a reduced pressure drop across a component so comprising the non-continuous tobacco material and a reduced firmness and fill value of a component comprising the non-continuous tobacco material.

These properties of the non-continuous tobacco material produced by the method of FIG. 2 were observed by manufacturing and comparing forty samples of first and second types of cigarette.

The first type cigarette was a King Size cigarette comprising a 21.8 mm length filter and an 60.8 mm length tobacco rod, wherein the tobacco rod was manufactured from 100% non-continuous tobacco material produced by the method of FIG. 2. It should be noted that usually a cigarette would contain only a proportion of the non-continuous tobacco material, for example, 5% or 10% as discussed above.

The second type of cigarette was a King Size cigarette comprising a 21.8 mm length filter and an 60.8 mm length tobacco rod, wherein the tobacco rod was manufactured from 100% cut-rag tobacco wrapped in an outer wrap.

The first and second types of cigarette both have a tobacco rod with an outer circumference of 24.7 mm.

In addition, the inclusion of the non-continuous tobacco material results in, during smoking of the tobacco rod, a reduced pressure drop across the component in comparison to if the tobacco rod did not comprise the non-continuous tobacco material.

The properties of the non-continuous tobacco material produced by the method of FIG. 2 were also observed by manufacturing and comparing forty samples of first and second types of cigarette that comprise 25% of cut-rolled-expanded stem (CRES).

The first type cigarette was a King Size cigarette comprising a 21.8 mm length filter and an 60.8 mm length tobacco rod, wherein the tobacco rod was manufactured from 75% non-continuous tobacco material produced by the method of FIG. 2 blended with 25% of cut-rolled-expanded stem (CRES).

The second type of cigarette was a King Size cigarette comprising a 21.8 mm length filter and an 60.8 mm length tobacco rod, wherein the tobacco rod was manufactured from 75% cut-rag tobacco blended with 25% of cut-rolled-expanded stem (CRES) wrapped in an outer wrap.

The first and second types of cigarette both have an outer circumference of 24.7 mm.

Forty of the first type of cigarette and forty of the second type of cigarette were then tested using a RM20H smoking machine according to ISO 4387 to measure: the tar, nicotine and carbon monoxide delivered per cigarette; the carbon monoxide to tar ratio; the tar delivered per puff of each cigarette; and, the nicotine delivered per puff of each cigarette.

TABLE 2

| | Type 1 (75% non-continuous material of the method and 25% CRES) | Type 2 (75% Cut Rag and 25% CRES) |
|---|---|---|
| Smoke Tar (mg/cig) | 12.4 | 9.2 |
| Smoke Nicotine (mg/cig) | 1.4 | 1.0 |
| Smoke CO (mg/cig) | 12.0 | 13.2 |
| Smoke Puff Count | 10.1 | 9.1 |
| CO/Tar ratio | 0.97 | 1.43 |
| Tar per puff (mg) | 1.23 | 1.01 |
| Nicotine per puff (mg) | 0.14 | 0.11 |
| Cigarette tobacco weight (mg) | 837 | 783 |

The above Table 2 shows the average measured values for the 40 of first type of cigarette and the average measured values for the 40 of the second type of cigarette. As before, the results show that the non-continuous tobacco material produced by the method of FIG. 2 has an increased tar and nicotine delivery, a reduced carbon monoxide delivery, a reduced carbon monoxide to tar ratio, a reduced pressure drop across a component comprising the non-continuous tobacco material. This is despite the fact that the cut-rag tobacco and the non-continuous tobacco material are both produced so from the same type of tobacco. In other words, both the cut-rag tobacco and the non-continuous tobacco material are both from the same type of tobacco plant, but the non-continuous tobacco material comprises a mixture of pre-sized stem, winnowings and tobacco fines that are processed according to the method of FIG. 2.

Referring now to FIG. 3, a processing apparatus 1 is shown. In the present embodiment, the processing apparatus 1 is a pressure defibration device 1.

The pressure defibration device 1 comprises a chamber housing 2 with a conveyor screw 3 disposed therein, which is rotated by means of a drive mechanism 4, for example, an electric motor 4.

The pressure defibration device 1 further comprises a tobacco material inlet 5A, a water inlet 6A and a casing and/or flavoring inlet 6B. The pressure defibration device 1 may further comprises a steam inlet 7.

The tobacco initial material is supplied to the tobacco material inlet 5A to enter the chamber housing 2, wherein the tobacco initial material passes along the chamber housing 2 upon rotation of the conveyor screw 3 such that the tobacco initial material passes from the tobacco material inlet 5A to an outlet 5B. At the outlet 5B of the chamber housing 2 is a head 8, which comprises a generally conical recess 8A.

A shearing member 10 is received in the recess 8A. A shearing gap 9 is formed between the shearing member 10 and the inner wall of the recess 8A. The tobacco initial material is conveyed through the gap 9 by the screw 3. The outlet 5B of the chamber 2 is in the form of an orifice that communicates the interior of the chamber 2 with the recess 8A. The orifice may be disposed at the gap apex of the generally conical recess 8A. The discharged, defibrated tobacco material is denoted by reference number 12.

In some embodiments, the shearing member 10 is in the form of a cone. The shearing gap 9 may be annular.

The shearing member 10 is coupled to an actuator mechanism 11 that is configured to rotate the shearing member 10. The shearing member 10 can be rotated about its central axis, the rotation indicated by the bent arrow in FIG. 3. In some embodiments, the actuator mechanism 11 comprises an electric motor.

In some embodiments, the actuator mechanism 11 is configured to move the shearing member 10 axially in order to adjust the size of the gap 9.

The axial movement of the shearing member 10 is indicated by the double arrow in FIG. 3, showing that the shearing member 10 can be moved towards and away from the head 8. Therefore, the shearing member 10 can be securely retained in its axial position, but may also be moved axially. As a result of this, the width of the gap 9 can be adjusted or adapted and, in some embodiments, a counter-pressure can be generated in the direction of the closure of the gap 9. The actuator mechanism 11 may be configured to move the shearing member 10 axially using a hydraulic or pneumatic actuator or using a linear gear arrangement such as a rack and pinion gear arrangement that is driven by an electric motor.

The first part of the process of defibrating the tobacco stems, at step (S3), takes place at a pressure above atmospheric pressure. This over pressure is generated as the tobacco initial material is conveyed along the chamber 2 via the screw 3 once it has been supplied to the inlet 5A.

The shearing gap 9 is disposed at the outlet end 5B of the chamber 2. The gap 9 virtually closes off the chamber 2 in the same manner as an extruder.

The gap 9 may be generally annular in cross-section. The width of the gap 9 in the axial direction of the conveyor screwed is determined by the axial position of the shearing member 10. Therefore, in embodiments wherein the axial position of the shearing member 10 is adjustable, the width of the gap 9 is also adjustable.

In step (S3), the tobacco initial material is subjected to increased pressure (of up to 200 bar) and increased temperature (in particular above 100° C.). In addition to the mechanical pressure which occurs due to the tobacco initial material being conveyed towards the gap 9, additional forces also act on the tobacco initial material because shearing forces act in the pitches of the conveyor screw in conjunction with the walls which cause the tobacco initial material to be cut and defibrated. The shearing effect can be assisted by introducing draughts through the housing wall or by introducing additional flow resistances. In addition, steam may be introduced at several points in so order to regulate the moisture, the temperature and the pressure in the conveyor screw or in the chamber 2. As a result of introducing steam and due to the natural moisture of the stems from the conditioning process, additional defibration of the tobacco initial material takes place on leaving the gap 9 because the water evaporates abruptly. Being under pressure, the moisture in the tobacco initial material evaporates abruptly as the pressure drops to atmospheric pressure downstream of the gap 9 and thus flash evaporation occurs.

In some embodiments, the tobacco initial material is placed under pressure mechanically, in particular mechanically pressed against the shearing gap 9 in the chamber 2. This being the case, the material may be placed under pressure by means of a conveyor screw, which presses the material towards the outlet end of the chamber 2 of a heatable screw conveyor, at which the shearing gap 9 is disposed. The initial material may also be coarsely pre-cut or coarsely pre-defibrated in the chamber 2 as it is fed towards the shearing gap.

In some embodiments, the shearing gap 9 is closed under pre-tensioning and is intermittently opened by the pressure of the tobacco material so that the material passes through the gap 9. Alternatively, the material may also advantageously be fed through a continuously opened shearing gap 9.

In some embodiments, the shearing gap 9 has a width in the range of 50 to 300 micrometers.

In some embodiments, the pressure chamber 2 has a conveyor system in the form of a plug screw feeder for conveying the tobacco material from the inlet 5A to the outlet 5B. In some embodiments pressure is generated by mechanical means, such as generated by a plug screw feeder for example, although other systems may also be used in principle within the context of the present disclosure, for example, using a piston system or alternatively, not mechanically or not only mechanically by using a gas pressure such as a pressurized gas supply.

If a plug screw feeder is used, in some embodiments it has reducing features which reduce the chamber volume in the region towards the outlet, for example, smaller screw pitches.

In some embodiments, mechanical pre-cutting features or pre-defibrating features are disposed in the pressure chamber 2. In one embodiment, a screw chamber pressure-conditioning device is disposed upstream of the device proposed by the invention in the same pressure chamber housing or in another one connected upstream. A pressure conditioning device of this type is described in patent DE 103 04 629 A1, for example, and can be combined with the pressure defibration device 1 of the present disclosure. The pressure conditioning device 1 may incorporate all the structural features illustrated in FIG. 1 and explained in the associated description of DE 103 04 629 A1 and reference may be made to these construction features for further details.

In some embodiments, the pressure chamber 2 comprises inlets for conditioning agents or casing agents and flavorings.

The conditioning and pressure defibration processes depends on the pressure conditions under which conditioning takes place. In some embodiments, the tobacco initial material is conditioned under atmospheric conditions and is fed by means of a feeding apparatus, for example, conveyor chutes or a conveyor belt, into the inlet 5A, for example, via a hopper. One or more of the constituents of the tobacco initial material may be conditioned separately. For instance, the stem material and winnowings may be separated separately and then combined with each other and the tobacco fines. In some embodiments, the stem material is conditioned before being pre-sized.

In some embodiments, the feeding apparatus comprises a silo (not shown) and a screw feeder (not shown). The tobacco initial material is stored in the silo and supplies the screw feeder, wherein the screw feeder supplies the tobacco initial material to the inlet 5A of the pressure defibration device 1.

The feeding apparatus may be configured to supply a predetermined flowrate of tobacco initial material to the processing apparatus 1. In some embodiments, the feeding apparatus is configured to supply tobacco initial material to the processing apparatus 1 at a flow rate in the range of 50 to 250 kg/h and, preferably, in the range of 95 to 175 kg/hour.

The conditioning process may take place at an axially intermediate point of the chamber 2 by introducing water and casing at the respective inlets 6A, 6B. In some alternative embodiments (not shown), the water and casing (and/or flavoring) are introduced at the same inlet, or only one of water and casing are introduced into the chamber 2.

At step (S4), the tobacco initial material passes through the gap 9 and is subjected to shearing between the walls of the head 8 and the shearing member 10 and also the flash evaporation mentioned above takes place on the material leaving the gap 9. Thus, the gap 9 acts as a shearing gap 9. The shearing and the flash evaporation both contribute to a well defibrated non-continuous tobacco product that can be used in aerosol provision systems.

In some embodiments, the shearing member 10 is rotated about its rotational axis in order to help prevent blockages from occurring in the gap 9. This rotation of the shearing member 10 may be continuous or intermittent or the direction of rotation may be alternated. This being the case, the rotation may be a full rotation or only a quarter or one third rotation or rotations of smaller/larger units. In an alternative embodiment (not shown), the shearing member 10 is stationary and the head 8 is rotated, for instance, being coupled to a drive mechanism. However, it should be recognized that in yet further embodiments, the head 8 and shearing member 10 do not rotate relative to each other.

In some embodiments, the head 8 and shearing member 10 comprise respective shearing surfaces 13, 14, wherein the gap 9 is formed between the shearing surfaces 13, 14. In some embodiments, the shearing surfaces 13, 14 are generally opposing.

In some embodiments, one or both of the shearing surfaces 13, 14 has one or more surface formations, for example, grooves or other roughening such as protrusions or depressions. In some embodiments, the surface formations, for example, grooves, may have a depth in the radial direction of at least 0.2 or at least 1 mm. The surface formations promote shearing of the tobacco initial material and may also promote more homogenous pressure conditions which leads to a more homogenous end product. In some embodiments, the grooves extend parallel to the central axis of the shearing member 10.

In some embodiments, the shearing member 10 comprises more than 80 grooves and, preferably, at least 90, 100, 120, 140, 160 or 180 grooves.

In some the grooves each have a maximum width in the range of 0.5 to 1.5 mm. The width of each groove may be constant or may vary. It has been found that a smaller groove width results in smaller lighter fibers in the defibrated non-continuous tobacco material. The width of the grooves is in the circumferential direction of the shearing member 10.

In some embodiments, the shearing surfaces 13, 14 are moveable apart from one another and towards one another. In some embodiments, the shearing member 10 is biased relative to the head 8 such that the shearing surfaces 13, 14 abut and thus the gap 9 is closed. Alternatively, the shearing surfaces 13, 14 are moveable apart from one another and towards one another with a fixed or fixedly adjustable distance, in which case the shearing surfaces 13, 14 lie at a fixed distance of 10 to 2000 microns, and preferably 50 to 300 microns. These figures relate to smooth shearing surfaces 13, 14. Alternatively, if the shearing surfaces 13, 14 comprise, for example, grooves then the distance refers to the distance between the parts of the surfaces 13, 14 between the grooves.

In some embodiments, the grooves of the shearing member 10 extend longitudinally or transversely to the direction in which the shearing surfaces 13, 14 move.

In some embodiments, the shearing surface 14 of the head 8 is stationary whereas the shearing surface 13 of the shearing member 10 is displaced axially. In some embodiments, the shearing surface 14 of the head 8 is displaced axially whereas the shearing surface 13 of the shearing member 10 is held stationary.

In some embodiments, the shearing surface 14 of the head 8 is stationary whereas the shearing surface 13 of the shearing member 10 is rotated. In some embodiments, the shearing surface 14 of the head 8 is rotated whereas the shearing surface 13 of the shearing member 10 is held stationary.

Rotation and axial movement of the shearing surface(s) 13, 14 may be caused by the same actuator mechanism 1. Alternatively, a first actuator mechanism may rotate one of the shearing surfaces 13, 14 whereas a second actuator mechanism may axially displace said one or the other one of the shearing surfaces 13, 14.

In some embodiments, the shearing surfaces 13, 14 are moved towards one another continuously or intermittently or in one or two directions or backwards and forwards.

In some embodiments, the gap 9 may be an annular gap, preferably a conical gap.

At step (S5), the material is cooled. The material may be cooled whilst being transported, for example, on a conveyor belt.

The resultant, defibrated process product exhibits similar properties to those of stems processed by shredders in terms of appearance and use. However, the pressure defibration processes and device of FIGS. 1 to 3 do not have the disadvantage of causing a lot of dust, as is the case when stems are processed by shredders, and moistening is not necessary to such a high degree, which enables subsequent drying to be significantly reduced or dispensed with.

In some embodiments, the produced non-continuous material has an average fiber diameter of less than 0.95 mm and, preferably, less than about 0.9 mm or 0.85 mm. In some embodiments, the average fiber diameter is about 0.8 mm or less. The average fiber diameter may be less than 0.8 mm. In some embodiments, the average fiber diameter is in the range of 0.6 to 0.8 mm. A smaller average fiber diameter results in a lighter non-continuous material that has a lower density. It has been found that a lower density of produced non-continuous material results in less of the non-continuous material being extracted as winnowings, and also less tobacco material in total being extracted as winnowings at the rod maker.

The produced non-continuous material may be a reconstituted material that is binder free.

Pre-sizing the stem material to a Dp90 particle size of less than 3 mm and to a Dp50 particle size of less than 2 mm also results in less 'flakes' in the produced non-continuous material. Flakes are generated when large unbroken stem particles leaving the chamber of the defibration device skip over the grooves of the shearing member. These flakes often have a particle size that is larger than the width of one or two grooves of the shearing member, and may have a diameter that is comparable to a regular size or King Size cigarette. The flakes are relatively light and therefore in general are not extracted as winnowings, and thus can have a detrimental effect on the taste of the final product and may cause elevated pressure drops in the aerosol provision system, for example, cigarette. If the produced non-continuous material is formed into a rod, the flakes may lead to inconsistencies in rod formation, thus negatively contributing to the end stability of the rod, meaning that more of the non-continuous material falls out the end(s) of the rod. Pre-sizing the stem material results in less flakes and thus alleviates these problems.

Figure 4:
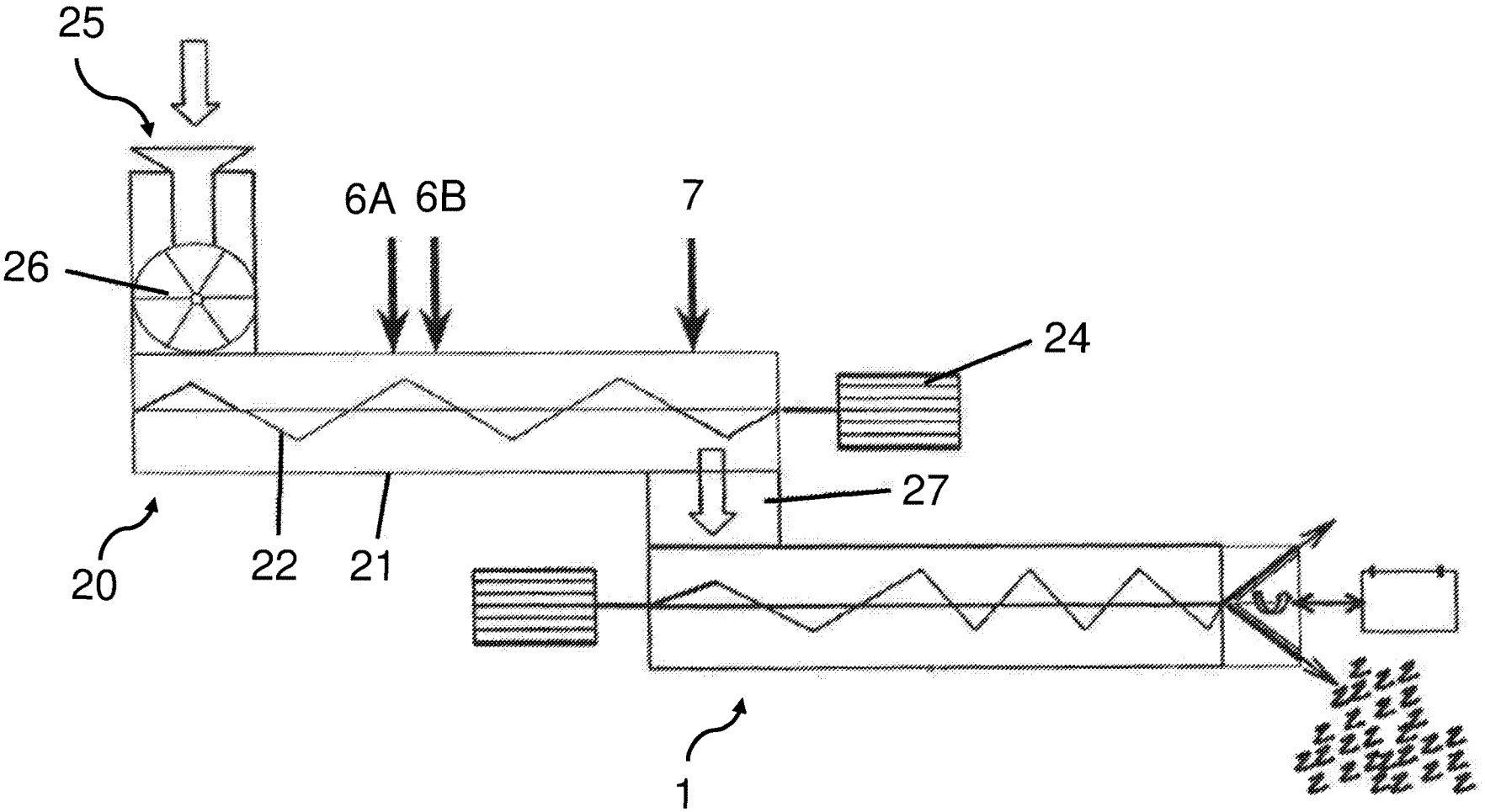
FIG. 4 is a schematic view of a pressure conditioning and defibration system; and, FIG. 5 is a schematic view of another embodiment of a pressure conditioning and defibration system.

Referring now to FIG. 4, another an embodiment of a processing apparatus is shown. The processing apparatus comprises a pressure defibration device 1 of the type described above with reference to FIG. 3. The processing apparatus further comprises a pressure conditioning device 20 connected upstream of the pressure defibration device 1.

The pressure defibration device 1 and pressure conditioning device 20 form part of a combined pressure conditioning and defibration system.

The pressure conditioning device 20 may be of the type illustrated in particular in FIG. 1 of patent specification DE 103 04 629 A1 and described in the associated part of the description. The latter is included herein by way of reference. It has a tobacco material inlet 25 and a differential pressure-proof cellular wheel sluice 26 through which the tobacco initial material is introduced into the pressure chamber 21, where it is transported with the aid of a conveyor screw 22. The conveyor screw 22 is driven by a drive mechanism, for example, a motor 24.

Disposed at the end of the chamber 21 is an outlet 27 for the tobacco material, which feeds the inlet 5A of the pressure defibration device 1. In some embodiments, unlike the device described in patent specification DE 103 04 629 A1 there is no differential pressure-proof sluice at the outlet of the pressure conditioning device. Instead, the tobacco initial material is transferred to the inlet 5A of the pressure defibration device 1 by the pressure of the chamber 22.

In other embodiments, the outlet from the pressure conditioning chamber 22 is operated using a cellular wheel sluice and decreasing the pressure. In such embodiments, the tobacco material may be transferred to the pressure defibration process at a lower pressure than in the pressure conditioning chamber, for example, ambient pressure. In some embodiments, the tobacco initial material is first treated by the pressure conditioning device 20 and is then transported to a separate pressure defibration device 1. The tobacco initial material may be manually transported between the pressure conditioning device 20 and pressure defibration device 1 or automatically, for example, using a conveyor belt or pneumatic conveyor.

However, it is preferable to avoid a drop in pressure during the transfer from the pressure conditioning device 20 to the pressure defibration device 1 to enable an above atmospheric pressure to be applied across the entire processing region from the start of conditioning through to the defibration process, as illustrated in FIG. 4. The tobacco initial material is fed through the differential pressure-proof cellular wheel sluice 26. The pressure-proofing of the sluice 26 at one end and the gap 9 which is always filled with defibrated tobacco material during operation make it possible to maintain a pressure above atmospheric pressure throughout the combined device. To this end, sealing of the cellular wheel sluice 26 may be optimized by heating its housing.

Once the tobacco initial material has been introduced into the chamber 22, the material is at a pressure above atmospheric pressure, which may be maintained by introducing steam to compensate for the natural leakage rates of the cellular wheel sluice 26 (gaps and spillage volumes). The tobacco initial material is heated by the steam and the moisture content increased. In principle, it would also be possible to operate a drying process in such a chamber using over-saturated steam, but when used for defibration, it is usually of advantage if the tobacco initial material introduced has a higher moisture content.

The tobacco initial material is conveyed through the conditioning chamber 21 by the conveyor screw 22. Different settings may be used for this purpose (pitch of the screw, rotation speed and inclination of the chamber), by means of which the dwell time of the tobacco initial material can be set. In some embodiments the dwell time is between 2 and 10 minutes.

After the pressure conditioning process, during which water, casing and/or flavoring material may also be added, the tobacco initial material is then transferred through the outlet 27 into the pressure defibration device 1. The process of introducing the tobacco so initial material may also be made easier if the housing is also of a hopper-type design. In some embodiments, the typical dwell time of the tobacco initial material in the pressure defibration device 1 is less than 2 minutes, in particular less than 1 minute. The tobacco material then leave the pressure defibration device 1 in the desired state described above.

Instead of the pressure conditioning screw, it would also be possible to use a conditioning screw operating at below atmospheric pressures.

In some embodiments, the pressure defibration device 1 comprises a single or twin screw conveyor with a shearing gap outlet for defibrating tobacco material. The shearing gap comprises an orifice, through which the material is sheared as it passes through.

Figure 5:
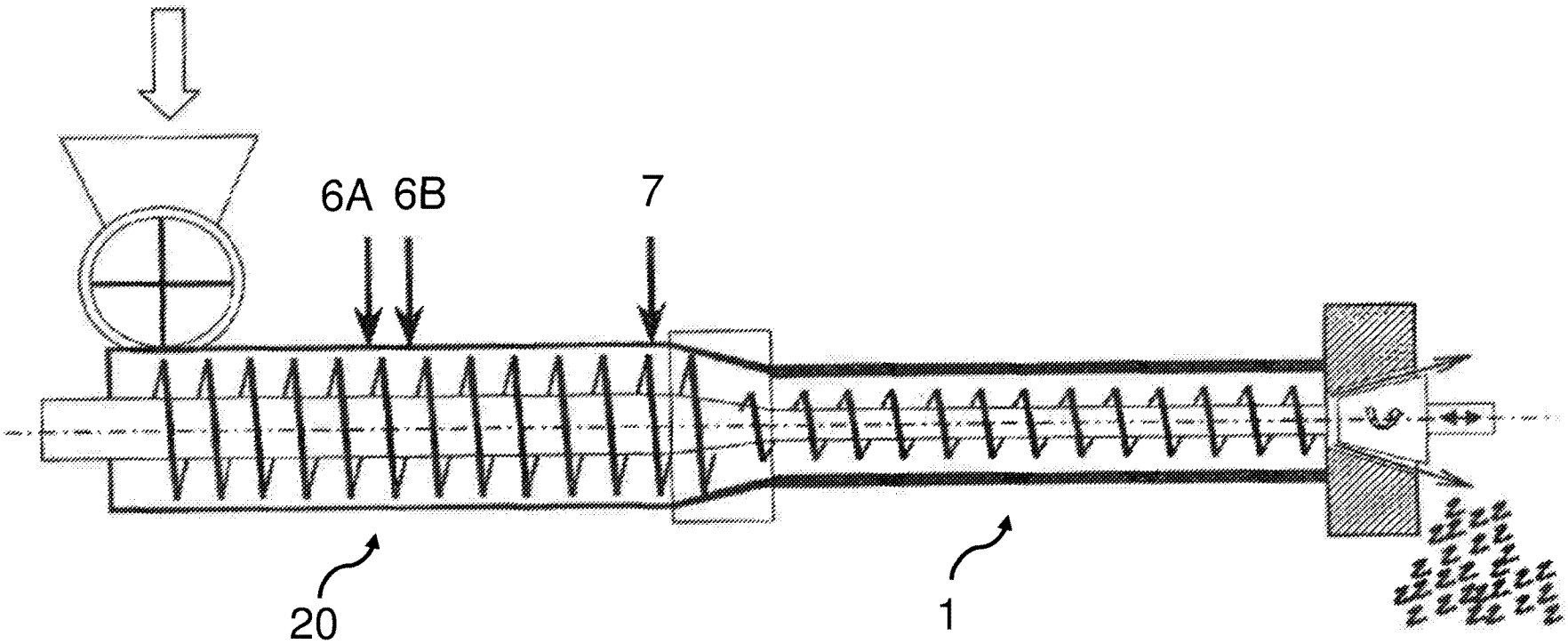

FIG. 5 illustrates another embodiment of a combined pressure conditioning and defibration system. The pressure conditioning device 20 and the pressure defibration device 1 are similar to those described above in reference to FIGS. 3 and 4, and therefore a detailed description will not be repeated hereinafter. A difference is that the conveyor screw of the conditioning device 20 and the defibration screw of the pressure defibration device 1 are provided on the same shaft and are driven by a single motor. If the same rotation speed is used for both screws, the different dwell times in the two process steps may be obtained using different methods, for example, by different cross-sections/volumes or release options in the region of the conditioning process.

In the embodiments of FIGS. 4 and 5, the steam and conditioning agents, for example, water and casing, are introduced through the appropriate inlets of the pressure conditioning device 20. Corresponding water, conditioning and steam inlets are omitted from the pressure defibration device 1. Flavoring and/or casing can be introduced in both pressure ranges, i.e. in one or both of the pressure chambers, or at atmospheric pressure, i.e. outside of the chambers.

In some embodiments, the produced non-continuous tobacco material has a density index in the range of 350 to 600 kg/m$^3$. The 'density index' of the non-continuous tobacco material may be calculated as follows:

The non-continuous tobacco material is ground for three seconds in a mill to reduce the so length of the fibers. An example of a mill that may be used to grind the non-continuous tobacco material is coffee grinder, for example, a Bialetti™ manual coffee grinder, with European Part Number 8002617994316. However, other types of mill are also suitable for grinding the non-continuous tobacco material to reduce the length of the fibers.

The non-continuous tobacco material is then sorted to collect material with a particle size in the range of 0.5 mm to 1.00 mm. For instance, the non-continuous tobacco material may be passed through a first sieve to collect non-continuous tobacco material with a particle size 1 mm and smaller and to reject material with a particle size greater than 1 mm. The collected non-continuous tobacco material is then passed through a second sieve to reject material with a particle size smaller than 0.5 mm. Alternatively, a sieving machine or other suitable apparatus may be used.

50 g of the collected non-continuous tobacco material having a particle size in the range of 0.5 to 1 mm is then stored in a climate controlled environment at 22° C. and 60% relative humidity for 24 hours.

The density index is then measured using a Borgwaldt DD 60A densimeter, in the same way that filling value is calculated but resetting the height prior to measurement using a transparent disc made from acrylic glass that has a diameter of 59.5 mm and a height of 15 mm. That is, the reset of the height is conducted including the transparent disc. In more detail, a 30 g portion of non-continuous tobacco material is filled into the measuring cylinder of the densimeter and the transparent disc is positioned on the non-continuous tobacco material. The measuring cylinder is softly bounced to obtain a flat and even surface between the non-continuous tobacco material and the transparent disc. Next, the measurement is obtained in the same manner as for the measurement of filling value.

The Density Index (DI) in kg/m$^3$ is calculated according to the following equation:

$$DI = (m/(9*\pi*\mathrm{h})*1000$$

DI=Density Index (kg/m3), M=the mass of the material (g), h=the height (cm).

The Density Index of the dry base material (DIb) can be calculated according to the following equation:

$$DIb = DI/((100 = OV)/100)$$

DIb=Density Index of the dry base material (kg/m$^3$), OV=oven volatiles (%) which are determined directly after the Densimeter measurements.

In some embodiments, the Density Index is in the range of 350 to 600 kg/m$^3$.

In some embodiments, the Density Index of the dry base material is in the range of 300 to 550 kg/m$^3$.

It has been found that a lower Density Index of the produced non-continuous tobacco material results in less of the non-continuous material being extracted as winnowings, and also less tobacco material in total being extracted as winnowings at the rod maker.

The present disclosure also relates to manufacturing a component for a delivery system such as an aerosol provision system.

The delivery system described herein can be implemented as a combustible aerosol provision system, a non-combustible aerosol provision system or an aerosol-free delivery system.

The method comprises combining the non-continuous material with a tobacco material, for example, cut tobacco, to form a tobacco mixture; and then forming the component from the tobacco mixture. In some embodiments, the tobacco mixture comprises at least 4.5% non-continuous material and, preferably, at least 5.5%, 6%, 6.5%, 7%, 8%, 9%, 10%, 11%, 12%, 13%, 14%, 15%, 16%, 17%, 18%, 19% or 20% non-continuous material (by mass) for a combustible product. In some embodiments, the tobacco mixture comprises 25% or less non-continuous material (by mass) for a combustible product such as a combustible aerosol provision system.

In some embodiments, for a non-combustible product, for example, a non-combustible aerosol provision system, the tobacco mixture comprises, preferably, at least 5%, and up to 100% non-continuous material (by mass).

In some embodiments, there is provided a component for a non-combustible aerosol provision system, the component comprising expanded tobacco material. The method as described herein results in tobacco material which is expanded, and expanded tobacco material can be provided in, for instance, an aerosol generating portion of an article for use in the non-combustible aerosol provision system, or the non-combustible delivery system, as described herein. There is also provided a non-combustible delivery system or a non-combustible aerosol delivery system comprising expanded tobacco material, for instance the tobacco material produced by the methods described herein. The non-combustible aerosol provision system can, for instance, be a tobacco heating product, or a hybrid system to generate aerosol using a combination of aerosol-generating materials, where one of the materials is an expanded tobacco material. An expanded tobacco material can also be used in an aerosol-free delivery system that delivers at least one substance to a user orally, nasally, transdermally or in another way without forming an aerosol, including but not limited to, lozenges, gums, patches, articles comprising inhalable powders, and oral products such as oral tobacco which includes snus or moist snuff, wherein the at least one substance may or may not comprise nicotine. The expanded tobacco material may be produced by exposing a tobacco material to a drop in pressure resulting in flash evaporation. Alternatively or in addition, the expanded tobacco material may be produced by feeding tobacco material through a shearing gap such that the tobacco material is defibrated by expansion.

In some embodiments, the component is for a combustible aerosol provision system or for a non-combustible aerosol provision system. In some embodiments, the component is a tobacco rod.

The present disclosure further relates to an aerosol provision system and to parts of the aerosol provision system comprising non-continuous material manufactured according to the present disclosure.

As used herein, the term "delivery system" is intended to encompass systems that deliver at least one substance to a user, and includes:

- combustible aerosol provision systems, such as cigarettes, cigarillos, cigars, and tobacco for pipes or for roll-your-own or for make-your-own cigarettes (whether based on tobacco, tobacco derivatives, expanded tobacco, reconstituted tobacco, tobacco substitutes or other smokable material);

non-combustible aerosol provision systems that release compounds from an aerosol-generating material without combusting the aerosol-generating material, such as electronic cigarettes, tobacco heating products, and hybrid systems to generate aerosol using a combination of aerosol-generating materials; and aerosol-free delivery systems that deliver the at least one substance to a user orally, nasally, transdermally or in another way without forming an aerosol, including but not limited to, lozenges, gums, patches, articles comprising inhalable powders, and oral products such as oral tobacco which includes snus or moist snuff, wherein the at least one substance may or may not comprise nicotine.

As used herein, the term "aerosol provision system" is intended to encompass combustible and non-combustible aerosol provision systems that deliver at least one substance to a user, and includes:

combustible aerosol provision systems, such as cigarettes, cigarillos, cigars, and tobacco for pipes or for roll-your-own or for make-your-own cigarettes (whether based on tobacco, tobacco derivatives, expanded tobacco, reconstituted tobacco, tobacco substitutes or other smokable material);

non-combustible aerosol provision systems that release compounds from an aerosol-generating material without combusting the aerosol-generating material, such as electronic cigarettes, tobacco heating products, and hybrid systems to generate aerosol using a combination of aerosol-generating materials.

According to the present disclosure, a "combustible" aerosol provision system is one where a constituent aerosol-generating material of the aerosol provision system (or component thereof) is combusted or burned during use in order to facilitate delivery of at least one substance to a user.

In some embodiments, the delivery system is a combustible aerosol provision system, such as a system selected from the group consisting of a cigarette, a cigarillo and a cigar.

In some embodiments, the disclosure relates to a component for use in a combustible aerosol provision system, such as a filter, a filter rod, a filter segment, a tobacco rod, a spill, an aerosol-modifying agent release component such as a capsule, a thread, or a bead, or a paper such as a plug wrap, a tipping paper or a cigarette paper.

According to the present disclosure, a "non-combustible" aerosol provision system is one where a constituent aerosol-generating material of the aerosol provision system (or component thereof) is not combusted or burned in order to facilitate delivery of at least one substance to a user.

In some embodiments, the delivery system is a non-combustible aerosol provision system, such as a powered non-combustible aerosol provision system.

In some embodiments, the non-combustible aerosol provision system is an electronic cigarette, also known as a vaping device or electronic nicotine delivery system (END), although it is noted that the presence of nicotine in the aerosol-generating material is not a requirement.

In some embodiments, the non-combustible aerosol provision system is an aerosol-generating material heating system, also known as a heat-not-burn system. An example of such a system is a tobacco heating system.

In some embodiments, the non-combustible aerosol provision system is a hybrid system to generate aerosol using a combination of aerosol-generating materials, one or a plurality of which may be heated. Each of the aerosol-generating materials may be, for example, in the form of a solid, liquid or gel and may or may not contain nicotine. In some embodiments, the hybrid system comprises a liquid or gel aerosol-generating material and a solid aerosol-generating material. The solid aerosol-generating material may comprise, for example, tobacco or a non-tobacco product.

Typically, the non-combustible aerosol provision system may comprise a non-combustible aerosol provision device and a consumable for use with the non-combustible aerosol provision device.

In some embodiments, the disclosure relates to consumables comprising aerosol-generating material and configured to be used with non-combustible aerosol provision devices. These consumables are sometimes referred to as articles throughout the disclosure.

In some embodiments, the non-combustible aerosol provision system, such as a non-combustible aerosol provision device thereof, may comprise a power source and a controller. The power source may, for example, be an electric power source or an exothermic power source. In some embodiments, the exothermic power source comprises a carbon substrate which may be energized so as to distribute power in the form of heat to an aerosol-generating material or to a heat transfer material in proximity to the exothermic power source.

In some embodiments, the non-combustible aerosol provision system may comprise an area for receiving the consumable, an aerosol generator, an aerosol generation area, a housing, a mouthpiece, a filter and/or an aerosol-modifying agent.

In some embodiments, the consumable for use with the non-combustible aerosol provision device may comprise aerosol-generating material, an aerosol-generating material storage area, an aerosol-generating material transfer component, an aerosol generator, an aerosol generation area, a housing, a wrapper, a filter, a mouthpiece, and/or an aerosol-modifying agent.

In some embodiments, the substance to be delivered may be an aerosol-generating material or a material that is not intended to be aerosolized. As appropriate, either material may comprise one or more active constituents, one or more flavors, one or more aerosol-former materials, and/or one or more other functional materials.

In some embodiments, the substance to be delivered comprises an active substance.

The active substance as used herein may be a physiologically active material, which is a material intended to achieve or enhance a physiological response. The active substance may for example be selected from nutraceuticals, nootropics, psychoactives. The active substance may be naturally occurring or synthetically obtained. The active substance may comprise for example nicotine, caffeine, taurine, theine, vitamins such as B6 or B12 or C, melatonin, cannabinoids, or constituents, derivatives, or combinations thereof. The active substance may comprise one or more constituents, derivatives or extracts of tobacco, *cannabis* or another botanical.

In some embodiments, the active substance comprises nicotine. In some embodiments, the active substance comprises caffeine, melatonin or vitamin B12.

In some embodiments, the substance to be delivered comprises an active substance.

The active substance as used herein may be a physiologically active material, which is a material intended to achieve or enhance a physiological response. The active substance may for example be selected from nutraceuticals, nootropics, psychoactives. The active substance may be naturally occurring or synthetically obtained. The active substance may comprise for example nicotine, caffeine, taurine, theine, vitamins such as B6 or B12 or C, melatonin, cannabinoids, or constituents, derivatives, or combinations thereof. The active substance may comprise one or more constituents, derivatives or extracts of tobacco, *cannabis* or another botanical.

In some embodiments, the active substance comprises nicotine. In some embodiments, the active substance comprises caffeine, melatonin or vitamin B12

As noted herein, the active substance may comprise one or more constituents, derivatives or extracts of *cannabis*, such as one or more cannabinoids or terpenes.

As noted herein, the active substance may comprise or be derived from one or more botanicals or constituents, derivatives or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, *eucalyptus*, star anise, hemp, cocoa, *cannabis*, fennel, lemongrass, peppermint, spearmint, rooibos, chamomile, flax, ginger, *Ginkgo biloba*, hazel, hibiscus, laurel, licorice (liquorice), matcha, mate, orange skin, *papaya*, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, *curcuma*, turmeric, sandalwood, cilantro, bergamot, orange blossom, myrtle, cassis, valerian, pimento, mace, damien, marjoram, olive, lemon balm, lemon basil, chive, *carvi, verbena*, tarragon, geranium, mulberry, *ginseng*, theanine, theacrine, maca, ashwagandha, damiana, guarana, chlorophyll, baobab or any combination thereof. The mint may be chosen from the following mint varieties: *Mentha* Arventis, *Mentha* c.v., *Mentha niliaca, Mentha piperita, Mentha piperita citrata* c.v., *Mentha piperita* c.v, *Mentha spicata crispa, Mentha cardifolia*, Memtha *longifolia, Mentha suaveolens variegata, Mentha pulegium, Mentha spicata* c.v. and *Mentha suaveolens*

In some embodiments, the active substance comprises or is derived from one or more botanicals or constituents, derivatives or extracts thereof and the botanical is tobacco.

In some embodiments, the active substance comprises or derived from one or more botanicals or constituents, derivatives or extracts thereof and the botanical is clove. Cloves contain several essential oils, for example eugenol, which is known to provide some of the characteristic taste of the clove and is considered to have an analgesic effect in traditional Chinese medicine.

In some embodiments, the active substance comprises or is derived from one or more botanicals or constituents, derivatives or extracts thereof and the botanical is selected from *eucalyptus*, star anise, cocoa and hemp.

In some embodiments, the active substance comprises or is derived from one or more botanicals or constituents, derivatives or extracts thereof and the botanical is selected from rooibos and fennel.

In some embodiments, the substance to be delivered comprises a flavor.

As used herein, the terms "flavor" and "flavourant" refer to materials which, where local regulations permit, may be used to create a desired taste, aroma or other somatosensorial sensation in a product for adult consumers. They may include naturally occurring flavor materials, botanicals, extracts of botanicals, synthetically obtained materials, or combinations thereof (e.g., tobacco, *cannabis*, licorice (liquorice), *hydrangea*, eugenol, Japanese white bark *magnolia* leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, *papaya*, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, so geranium, khat, naswar, *betel*, shisha, pine, honey essence, rose oil, vanilla, lemon oil, orange oil, orange blossom, cherry blossom, *cassia*, caraway, cognac, jasmine, ylang-ylang, sage, fennel, wasabi, piment, ginger, coriander, coffee, hemp, a mint oil from any species of the genus *Mentha, eucalyptus*, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, *curcuma*, cilantro, myrtle, cassis, valerian, pimento, mace, damien, marjoram, olive, lemon balm, lemon basil, chive, *carvi, verbena*, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some embodiments, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from *cannabis*.

In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol, WS-3.

Aerosol-generating material is a material that is capable of generating aerosol, for example when heated, irradiated or energized in any other way. Aerosol-generating material may, for example, be in the form of a solid, liquid or gel which may or may not contain an active substance and/or flavourants. In some embodiments, the aerosol-generating material may comprise an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some embodiments, the aerosol-generating material may for example comprise from about 50 wt %, 60 wt % or 70 wt % of amorphous solid, to about 90 wt %, 95 wt % or 100 wt % of amorphous solid.

The aerosol-generating material may comprise one or more active substances and/or flavors, one or more aerosol-former materials, and optionally one or more other functional material.

The aerosol-former material may comprise one or more constituents capable of forming an aerosol. In some embodiments, the aerosol-former material may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

The one or more other functional materials may comprise one or more of pH regulators, coloring agents, preservatives, binders, fillers, stabilizers, and/or antioxidants.

The material may be present on or in a support, to form a substrate. The support may, for example, be or comprise paper, card, paperboard, cardboard, reconstituted material, a plastics material, a ceramic material, a composite material, glass, a metal, or a metal alloy. In some embodiments, the support comprises a susceptor. In some embodiments, the susceptor is embedded within the material. In some alternative embodiments, the susceptor is on one or either side of the material.

A consumable is an article comprising or consisting of aerosol-generating material, part or all of which is intended to be consumed during use by a user. A consumable may comprise one or more other components, such as an aerosol-generating material storage area, an aerosol-generating material transfer component, an aerosol generation area, a housing, a wrapper, a mouthpiece, a filter and/or an aerosol-modifying agent. A consumable may also comprise an aerosol generator, such as a heater, that emits heat to cause the aerosol-generating material to generate aerosol in use. The heater may, for example, comprise combustible material, a material heatable by electrical conduction, or a susceptor.

A susceptor is a material that is heatable by penetration with a varying magnetic field, such as an alternating magnetic field. The susceptor may be an electrically-conductive material, so that penetration thereof with a varying magnetic field causes induction heating of the heating material. The heating material may be magnetic material, so that penetration thereof with a varying magnetic field causes magnetic hysteresis heating of the heating material. The susceptor may be both electrically-conductive and magnetic, so that the susceptor is heatable by both heating mechanisms. The device that is configured to generate the varying magnetic field is referred to as a magnetic field generator, herein.

An aerosol-modifying agent is a substance, typically located downstream of the aerosol generation area, that is configured to modify the aerosol generated, for example by changing the taste, flavor, acidity or another characteristic of the aerosol. The aerosol-modifying agent may be provided in an aerosol-modifying agent release component, that is operable to selectively release the aerosol-modifying agent The aerosol-modifying agent may, for example, be an additive or a sorbent. The aerosol-modifying agent may, for example, comprise one or more of a flavourant, a colorant, water, and a carbon adsorbent. The aerosol-modifying agent may, for example, be a solid, a liquid, or a gel. The aerosol-modifying agent may be in powder, thread or granule form. The aerosol-modifying agent may be free from filtration material.

An aerosol generator is an apparatus configured to cause aerosol to be generated from the aerosol-generating material. In some embodiments, the aerosol generator is a heater configured to subject the aerosol-generating material to heat energy, so as to release one or more volatiles from the aerosol-generating material to form an aerosol. In some embodiments, the aerosol generator is configured to cause an aerosol to be generated from the aerosol-generating material without heating. For example, the aerosol generator may be configured to subject the aerosol-generating material to one or more of vibration, increased pressure, or electrostatic energy.

In order to address various issues and advance the art, the entirety of this disclosure shows by way of illustration various embodiments in which the claimed invention(s) may be practiced and provide for superior manufacture of tobacco material. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A method of processing tobacco fines into a non-continuous tobacco material, the method comprising:

providing a pre-sized tobacco stem material that has a Dp90 particle size of less than 3 mm and a Dp50 particle size of less than 2 mm;

combining the pre-sized tobacco stem material with tobacco fines to provide a tobacco initial material; and, processing the initial material by setting the initial material to a predefined increased moisture content, subjecting the initial material to an increase in temperature and subjecting the initial material an increased pressure in order to bind the tobacco fines to the tobacco stem material;

feeding the processed tobacco material through a shearing gap such that the processed tobacco is defibrated by expansion, wherein the shearing gap is arranged between shearing surfaces, wherein a rotatable shearing member comprises one of the shearing surfaces, wherein the shearing member comprises a plurality of grooves, and wherein the grooves each have a maximum width of at most 2 mm.

2. A method according to claim 1, wherein the pre-sized stem material has a Dp90 particle size of less than 2.9 mm and, optionally, less than 2.8, 2.7, 2.6, 2.5, 2.4, 2.3, 2.2, 2.1 or 2 mm.

3. A method according to claim 1, wherein the pre-sized stem material has a Dp50 particle size of less than 1.9 mm and, optionally, less than 1.8, 1.7, 1.6, 1.5, 1.4, 1.3, 1.2, 1.1 or 1 mm.

4. A method according to claim 1, wherein the initial material further comprises winnowings.

5. A method according to claim 1, wherein the tobacco fines have a particle size smaller than 1 mm and, optionally, smaller than 0.5 mm.

6. A method according to claim 1, wherein the tobacco fines are bound to the pre-sized tobacco stem material mechanically, without using any externally applied binding agents.

7. A method according to claim 1, wherein the step of processing the initial material comprises conveying the initial material through a conveyor which builds up a mechanical pressure.

8. A method according to claim 7, wherein the conveyor comprises an extruder.

9. A method according to claim 7, wherein the conveyer is operated at a throughput of greater than 100 kg/hr.

10. A method according to claim 1, comprising pre-conditioning the stem material and/or winnowings to one or more of the following parameters: Temperature: 80-147 [deg.] C; Moisture: in the range of 6-14% OV by mass; and, Pressure (gas over-pressure): 0-8 bar.

11. A method according to claim 1, wherein processing the initial material comprises setting the initial material to a moisture content in the range 10 to 50% OV (oven volatiles) by mass.

12. A method according to claim 1, wherein processing the initial material comprises heating the initial material to a temperature in the range of 60 to 180° C.

13. A method according to claim 1, wherein processing the initial material comprises pressurising the initial material to a pressure in the range 10 to 200 bar.

14. A method according to claim 1, wherein the non-continuous tobacco material is a fibrous and/or granular material.

15. A method according to claim 1, wherein the tobacco initial material comprises in at least 30% pre-sized tobacco stem material (by mass).

16. A method according to claim 1, comprising exposing the processed tobacco material to a drop in pressure resulting in flash evaporation.

17. A method according to claim 1, wherein the shearing gap has a width in the range of 10 to 2000 microns.

18. A method according to claim 1, wherein the shearing member comprises at least 80 grooves.

19. A method according to claim 18, wherein the grooves each have a maximum width of at most 1.5 or 1 mm.

20. A method according to claim 1, comprising rotating the shearing member at an angular velocity of at least 10 rpm.

21. A method according to claim 1, wherein the non-continuous tobacco material has an average fiber diameter of less than 0.9 mm.

22. A method according to claim 1, wherein the non-continuous tobacco material has a density index in the range of 350 to 600 kg/m$^3$.

* * * * *